US007367463B2

(12) United States Patent
Maruyama

(10) Patent No.: US 7,367,463 B2
(45) Date of Patent: May 6, 2008

(54) SELF-TRAVELING WORKING MACHINE

(75) Inventor: Katsuya Maruyama, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 11/611,265

(22) Filed: Dec. 15, 2006

(65) Prior Publication Data

US 2007/0080127 A1 Apr. 12, 2007

Related U.S. Application Data

(63) Continuation of application No. 10/490,204, filed as application No. PCT/JP02/10126 on Sep. 27, 2002, now Pat. No. 7,195,126.

(30) Foreign Application Priority Data

| | | |
|---|---|---|
| Sep. 28, 2001 | (JP) | 2001-302382 |
| Sep. 28, 2001 | (JP) | 2001-302383 |
| Oct. 4, 2001 | (JP) | 2001-308725 |
| Aug. 30, 2002 | (JP) | 2002-252489 |

(51) Int. Cl.
*B66C 23/36* (2006.01)

(52) U.S. Cl. ..... 212/231; 280/797

(58) Field of Classification Search ..... 280/797, 280/798

See application file for complete search history.

(56) References Cited

U.S. PATENT DOCUMENTS

| | | | | |
|---|---|---|---|---|
| 1,494,277 | A * | 5/1924 | Mostaza | 212/251 |
| 2,653,829 | A * | 9/1953 | Sheehan | 280/797 |
| 2,669,462 | A * | 2/1954 | Toncray et al. | 280/785 |
| 2,676,030 | A * | 4/1954 | Sherman | 280/797 |
| 3,003,649 | A | 10/1961 | Przybylski | |
| 3,095,945 | A | 7/1963 | Mitchell | |
| 3,300,069 | A | 1/1967 | Kline | |
| 3,509,965 | A | 5/1970 | Mitchell | |
| 3,709,322 | A | 1/1973 | Mitchell | |
| 4,031,807 | A * | 6/1977 | Boyer | 89/36.13 |
| 4,200,162 | A * | 4/1980 | Tax | 180/23 |
| 4,393,607 | A | 7/1983 | Hirosawa | |
| 6,443,687 | B1 * | 9/2002 | Kaiser | 414/685 |

FOREIGN PATENT DOCUMENTS

| | | | |
|---|---|---|---|
| JP | 3-211193 | | 9/1991 |
| JP | 6-39316 | | 5/1994 |
| JP | 2529509 | | 12/1996 |
| JP | 9-39645 | * | 2/1997 |
| JP | 10-231087 | | 9/1998 |
| JP | 10-236779 | | 9/1998 |
| JP | 11-35285 | * | 2/1999 |
| JP | 11-222382 | | 8/1999 |
| JP | 2000-16106 | | 1/2000 |
| JP | 2000-344134 | | 12/2000 |
| JP | 2001-140575 | | 5/2001 |

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

In a self-traveling working machine such as a crane, a working attachment such as a boom is arranged to transversely extend below an operator's cabin in such a manner that part of the cabin overlaps the attachment, it being arranged that during crane operation, the cabin is moved widthwise outside the working machine to avoid interference with the boom.

6 Claims, 24 Drawing Sheets

SELF-TRAVELING WORKING MACHINE

TECHNICAL FIELD

The present invention relates to a self-traveling working machine such as a rough terrain crane.

BACKGROUND ART

The rough terrain crane (also called a wheeled crane) as one kind of self-traveling working machines has conveniences capable of small sharp turns and capable of moving quickly, and therefore the crane has been used also in a small scaled construction site for construction of a private house or the like. Further, a residential district is so narrow in road width that the crane need to move into a narrow section passing through the roads provided with obstacles such as electric poles, street lamps, trees and the like, and therefore various devices have been made to narrow the width of the machine.

As a rough terrain crane having the width of the machine reduced, the crane disclosed, for example, in Japanese Patent Publication No. Hei 6-39316 is well known.

In this crane, a multiple telescopic boom as a working attachment is offset toward one side from the center of the machine body in order to narrow the width of the machine while securing a space of a cabin.

However, in the boom of the rough terrain crane, a rate of weight held with respect to the weight of the machine body is very large, about ⅓, and therefore such a large-weight boom as described is offset, the center of gravity of the machine body of the whole rough terrain crane is deviated from the center in the width direction of the machine body. Accordingly, the machine body becomes unbalanced in terms of weight to the left and right, and therefore a tilting angle defined in the vehicle control rule in Japan cannot be secured as the case may be, failing to clear car inspection, thus producing an evil that cannot run on a general public road as a vehicle.

Further, conventional self-traveling working machines including a self-traveling crane had the following problems.

A. Problem on the center of gravity of the machine body

A description will be made of a self-traveling crane disclosed in Japanese Patent Laid-Open No. Hei 9-39645 Publication, as an example (see FIGS. 27-29).

This self-traveling crane is that a position of the center of gravity of the machine body is lowered, and a frame (a traveling frame) of a lower traveling body is made to have a high rigidity, thereby enhancing the ability of the crane.

That is, in a self-traveling crane having a crane apparatus mounted on a traveling frame 72 of a lower traveling body 71, the traveling frame 72 is formed to be box-like whose section is almost closed by two side plates 72*c*, 72*c* opposed to each other by connecting an upper plate 72*a*, a bottom plate 72*b*, and an upper plate 72*a*, a bottom plate 72*b*.

Further, front and rear drive shafts (hereinafter referred to as an axle) 74, 74 pass through the traveling frame 72 through through-holes 73, 73 provided in the side plates 72*c*, 72*c* of the traveling fame 72, and drive shafts 75, 75 for transmitting power to differential gears of the axles 74, 74 also pass through the traveling frame 72.

A rotating pedestal portion or a rotating base 76 is disposed in a center portion in the width direction of the traveling frame 72, and an upper rotating body 79 provided with a multistage telescopic rising/falling boom 77 as a working attachment and a cabin 78 is mounted on the rotating pedestal portion 76.

An engine 80 is mounted at the rear of the traveling frame 72.

The following effects can be obtained by employing the above-described structure for the traveling frame 72 of the self-traveling crane.

① By passing the axle 74 through the traveling frame 72, the position of the traveling frame 72 lowers to lower the height to a roof of the cabin 78, that is, lower the height of the crane in its traveling attitude.

Because of this, since the position of the center of gravity of the whole crane lowers, the tilting angle becomes large, and the stability during crane operation enhances. Further, the position of the center of gravity of the crane lowers to thereby provide an allowance in the vertical direction. That is, the height of the traveling frame 72 itself can be made high, and a sectional area of the traveling frame 72 can be made large, thus enhancing the strength thereof.

However, according to the above-described crane, the rotating pedestal portion 76 for supporting the upper rotating body 79 rotatably is disposed on the upper surface of the traveling frame 72 and is at a position above the support position of the front and rear axles 74, 74, which is therefore insufficient in terms of lowering the height of the machine, and particularly, smaller the width of the machine, it is difficult to secure the traveling stability.

B. Problem on the length of the working attachment

In the self-traveling working machine including a self-traveling crane, the upper rotating body is rotatably mounted on the lower traveling body provided with wheels or crawlers, and the cabin and the working attachment are provided on the rotating frame of the upper rotating body.

In the case of the crane, as the working attachment, the multistage telescopic boom is generally supported free to rise and fall on the rotating frame and mounted from backward to forward of the rotating frame passing through one side of the cabin in the maximum fallen state.

Incidentally, the lengthy working attachment is sometimes required in a narrow depending on the using conditions of the machine, but in mounting the lengthy working attachment in the self-traveling working machine, there results in the multistage system in order to secure the performance at the time of normal traveling time and the workability in a narrow, and the longer the length, the number of stages of the working attachment increases to increase the weight thereof.

For solving such a problem as described above, in the mobile crane shown, for example, in Japanese Utility Model Registration No 2529509 Publication, the base end of the internal boom is projected rearward from the base end of the external boom in the state that the telescopic boom is most contracted, whereby a pivotal connecting position (a rising/falling position) of the external boom can be moved in the direction of the end of the telescopic boom by a length portion corresponding to the rearward projecting amount of the internal boom.

As a result, the telescoping stroke of the internal boom with respect to the external boom can be increased without increasing the rotating radius of the rear end of the upper rotating body when the crane is working.

Further, in the crane proposed in Japanese Patent Laid-Open No. Hei 3-211193 Publication, the boom is rotatably pivoted at the end of the base boom, the base boom is made to be rocked laterally with respect to the boom base portion, and even if the lengthy boom is arranged to meet a condition, namely, the radius of rear end of boom at the time of travel>radius of rear end of frame>radius of rear end of boom at the time of working, the safety at the time of traveling is secured, and the rotating radius of the rear end when the crane is working is made small to enhance the workability at a narrow.

Further, in the anchor executing machine proposed in Japanese Patent Laid-Open No. 2001-140575 Publication, the boom bracket can be moved laterally with respect to the base frame to thereby enhance freedom of execution.

However, in the art shown in the aforementioned Japanese Utility Model Registration No. 2529509 Publication, the internal boom is movably arranged within the external boom so that the internal boom is projected from the rearward of the external boom, and therefore the full length of the external boom is unavoidably shortened. Accordingly, there poses a problem that the number of stages of the telescopic boom increases naturally, and the weight of the telescopic boom increases.

Further, a trouble occurs in rising/falling rocking of the telescopic boom unless the internal boom is moved in an extending direction with respect to the external boom, and therefore a clearance is provided at the lower portion of the telescopic boom, which poses a further problem that a position of the center of gravity of the telescopic boom is high. There is possibility of impairing the stability of the mobile crane during traveling.

On the other hand, in the art shown in Japanese Patent Laid-Open No. Hei 3-211193, the base frame and the boom constitute an articulated boom, therefore posing a problem that construction becomes complicated and the weight increases. Further, there poses a further problem that the height of the rear end portion of the boom is high, and a position of the center of gravity of the boom is high, and the stability of the machine body during traveling is possibly impaired.

Further, in the anchor executing machine shown in Japanese Patent Laid-Open No. 2001-140575, the boom bracket itself can be moved laterally, with respect to the structures of the mobile crane shown in Japanese Utility Model Registration No 2529509 Publication, and the crane shown in Japanese Patent Laid-Open No. Hei 3-211193, but the boom bracket can be moved only on the upper rotating body, thus posing a problem that when a lengthy boom is mounted, the projecting amount forward of the upper rotating body increases or the number of stages of the boom increases, resulting in an increase of movement into a narrow or of weight. Further, in the anchor execution machine, since the boom is pivoted at a high position, the center of gravity of the machine body is also high.

With respect to the self-traveling working machine which runs on the road, there are many problems such as a problem of a weight limit of road, and, there is disadvantageous in terms of the travel performance such as acceleration, braking or turning due to an increase in inertia force during traveling resulting from an increase in weight, and the traveling apparatus for supporting a great weight is unavoidably large-scaled, resulting in an increase in weight by which the entry into a narrow is lost. Further, the higher the center of gravity of the machine body, there is disadvantageous in terms of traveling stability with respect to the direction of falling down toward the side.

DISCLOSURE OF THE INVENTION

Therefore, the present invention provides a self-traveling working machine capable of contracting the width of the machine while securing a space for a cabin as much as possible.

The present invention further provides a self-traveling working machine for lowering the center of gravity of the machine body whereby the traveling stability is secured, and sufficient strength and rigidity of a lower frame can be secured.

The present invention further provides a self-traveling working machine capable of reducing the weight of a lengthy working attachment, and of improving an entry property into a narrow, and workability in a narrow.

For solving the above-described problems, the present invention employed the following structures.

The present invention provides a self-traveling working machine in which an upper traveling body is mounted on a lower traveling body, and a working attachment free to rise and fall and a cabin are provided on a rotating frame of the upper rotating body, characterized in that the working attachment is disposed so as to transversely extend at a lower side of the cabin in the maximum fallen state of the working attachment, the cabin is arranged so that at least a part thereof is superposed to the upper surface of the working attachment, and there is provided an interference avoiding means for avoiding interference of the cabin with the working attachment when the working attachment is risen and fallen.

The present invention further provides a self-traveling working machine in which an upper rotating body is rotatably mounted on a traveling frame of a lower traveling body, characterized in that the traveling frame is provided with a rotating base for rotatably supporting the upper rotating body in the vicinity of a central portion of the traveling frame, and axle supporting portions provided frontward and rearward, respectively, of the rotating base, the upper surface of the rotating base being positioned downward from the upper surface of the axle supporting portions.

The present invention further provides a self-traveling working machine in which an upper traveling body is mounted on a lower traveling body, a working attachment free to rise and fall and a cabin are provided on a rotating frame of the upper rotating body, and the working attachment is arranged from rearward to forward of the rotating frame passing a side of the cabin in the maximum fallen state, characterized in that the rotating frame has a base frame connected to the lower traveling body and a movable frame adapted to move in a backward and forward direction with respect to the base frame, and the movable frame has a fulcrum on a rising and falling of the working attachment, the fulcrum being movable rearward from the rear end of the base frame.

BEST MODE FOR CARRYING OUT THE INVENTION

In the following embodiments, a wheeled crane (a rough terrain crane), which is one kind of a self-traveling crane is employed, as an example, as a self-traveling working machine to which the present invention is applied.

First Embodiment (see FIGS. 1 to 11)

Figure 1:
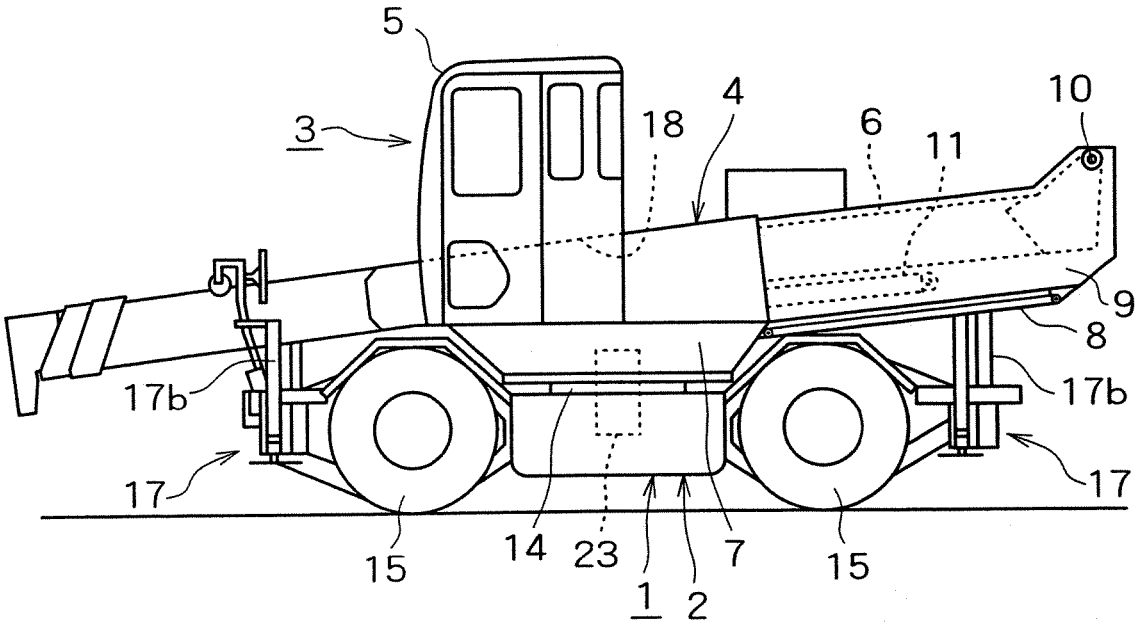
FIG. 1 is a schematic side view of the whole of a self-traveling crane according to a first embodiment of the present invention.
Figure 2:
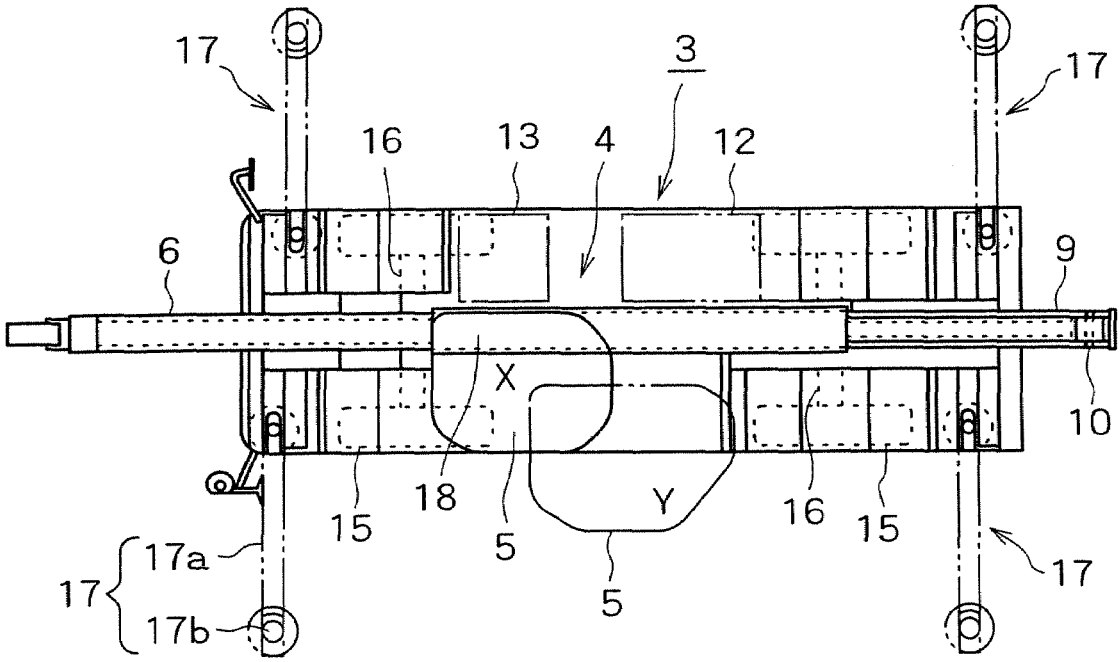
FIG. 2 is a plan view of the same.

FIGS. 1 and 2 show the whole crane according to this embodiment.

In these figures, reference numeral 1 denotes a wheel type lower traveling body. A rotating frame 4 of an upper traveling body 3 is mounted rotatably around a vertical axis on a traveling frame 2 of the lower traveling body 1, and an operator's cabin 5 co-used at the time of operation of the crane and at the time of travel, and a multiple or multi-step telescopic boom 6 as working attachment are provided with the rotating frame 4.

The rotating frame 4 comprises a rotatable base frame 7 as a rotating frame main body, and a movable frame 9 supported in a forwardly inclined state that a front end portion thereof is lower than a rear end portion by the base frame 7 and moved in a backward and forward direction by a frame moving cylinder 8, and a boom 6 is supported free to rise and fall on the rear end portion of the movable boom 9 through a boom foot pin 10. Reference numeral 11 denotes a boom rising/falling cylinder.

Meanwhile, hydraulic devices, a hydraulic pump for supplying pressure oil to the hydraulic devices, an engine 12 as a drive source for the pump or the like, and a working oil tank 13 are disposed on the rotating frame 4.

The rotating frame 4 is rotatably mounted through a rotating bearing 14 in an approximately center portion in a backward and forward (machine length) direction of the traveling frame 2 and in a width (machine width) direction or widthwide.

Axles 16, 16 having tires 15, 15 mounted at their ends thereof are provided on both front and rear sides of the traveling frame 2.

Further, on both front and rear end portions of the traveling frame 2, there is provided an outrigger device 17 provided with an outrigger beam 17*a* bulged outward in the width direction during crane operation, and an outrigger cylinder 17*b* extended downward in the state that the outrigger is bulged to raise the whole crane. Meanwhile, when the crane is traveling, the outrigger cylinder 17*b* is contracted, and the outrigger beam 17*a* is contracted and stored inside the crane body.

The base frame 7 of the rotating frame 4 is arranged at an approximately central portion in the width direction (the width direction of the whole crane) of the lower traveling body 1, and the movable frame 9 is supported on the base frame 7.

Accordingly, the boom 6 is positioned at an approximately center portion in the width direction in its maximum fallen state when the crane is traveling.

Further, the boom 6 is constructed so that the extreme end thereof is to be a front end of the whole crane, and the rear end is to be a rear end of the whole crane.

Further, as shown in FIG. 2, at one side for holding the boom 6 of the rotating frame 4, that is, the cabin 5, on the left side with respect to the crane advancing direction, and, at the other side, the engine 12 and the working oil tank 13 are disposed on the right side, respectively. By the above arrangement, the center of gravity of the machine body is positioned at a central position widthwise.

An escape portion 18 along an upper end shape of the boom 6 is formed on the cabin 5 at its lower position on the central side of the machine body, and when the cabin 5 is at a position X within the width of the machine body as width internal position shown by the solid line in FIG. 2, a part of the upper surface of the maximum fallen boom 6 faces the escape portion 18.

That is, a part of the cabin 5 positioned at the boom side overlaps a part of the boom 6 positioned at the cabin side.

In this manner, the escape portion 18 is formed at the lower position of the cabin 5 whereby a sufficiently large space can be secured within the cabin 5, and particularly, the upper internal space where an operator tends to feel an oppressive sensation can be widen.

Here, when the structure is employed in which the cabin 5 is superposed to a part of the upper surface of the boom 6 as described above, the boom 6 cannot be risen to carry out working of the crane.

So, in this crane, cabin moving means as interference avoiding means for avoiding interference between the boom 6 and the cabin 5 at the time of work is provided, by which means the cabin 5 can be moved from the width internal position X to a left obliquely rear side projecting position Y as side projecting position without giving trouble to the rising/falling operation of the boom 6.

Figure 3:
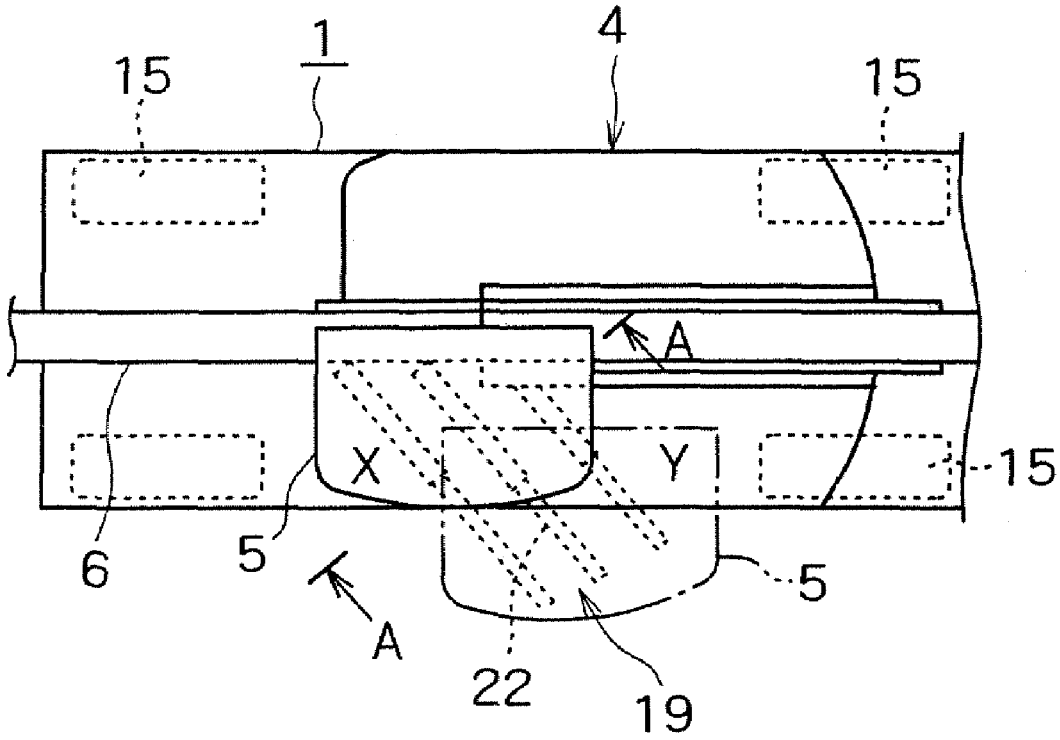
FIG. 3 is a plan view of a cabin and a peripheral portion thereof in the crane.
Figure 4:
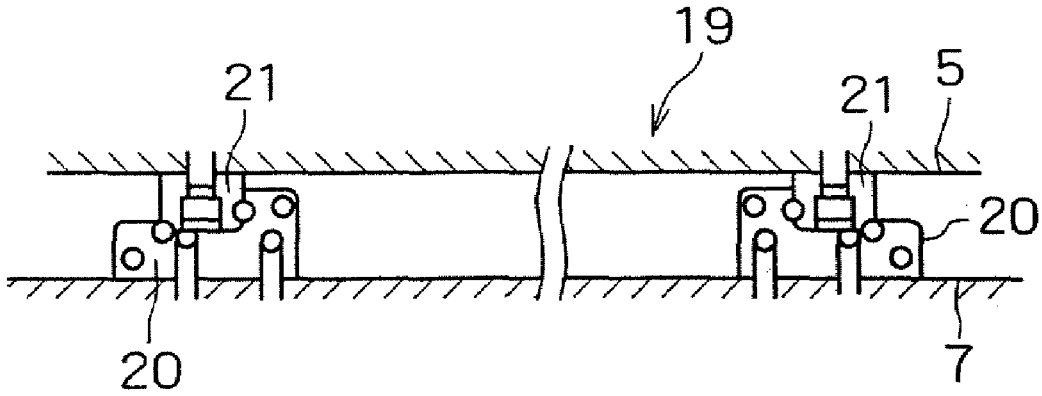
FIG. 4 is a sectional view taken on line A-A of FIG. 3.
Figure 5:
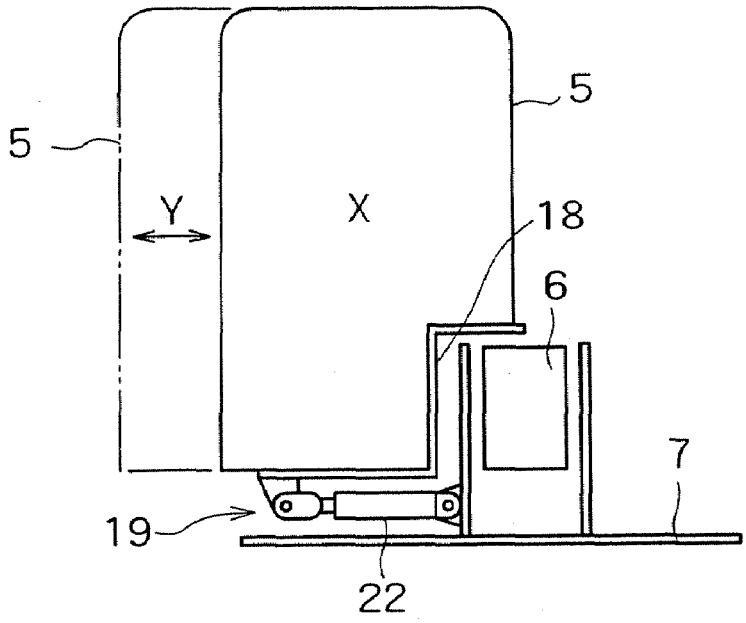
FIG. 5 is a back view of a cabin and a peripheral portion thereof.

This point will be described in detail with reference to FIGS. 3 to 5.

The cabin moving means 19 comprises a pair of rail-like guides 20, 20 disposed in parallel with the base frame 7 of the rotating frame 4, rail-like sliders 21, 21 disposed on the bottom surface of the cabin 5, engaged with the rail-like guides 20, 20 so as to enable sliding, and a cabin moving cylinder 22 provided between the base frame 7 and the bottom surface of the cabin 5 between both the rail-like guides 20, 20.

Note, the cabin 5 is moved to the left obliquely rear side projecting position Y because of securing the moving amount necessary to avoid the boom 6 of the cabin 5, and being perpendicular to a center line in the width direction of the lower traveling body 1, and accessing to a straight line passing through a rotating center point of the upper rotating body 3 to thereby prevent projecting of the cabin 5 outside the maximum rear end rotating radius of the crane.

Incidentally, the boom 6 is risen due to erroneous operation when the cabin 6 is at the width internal position X, the cabin 5 may be possibly damaged. So, a controller (not shown) to control actuators so that the boom 6 cannot be risen when the cabin 5 is at the width internal position X processes signals from sensors. In the following, the method for controlling the boom will be described with reference to FIGS. 6 to 8.

Figure 6:
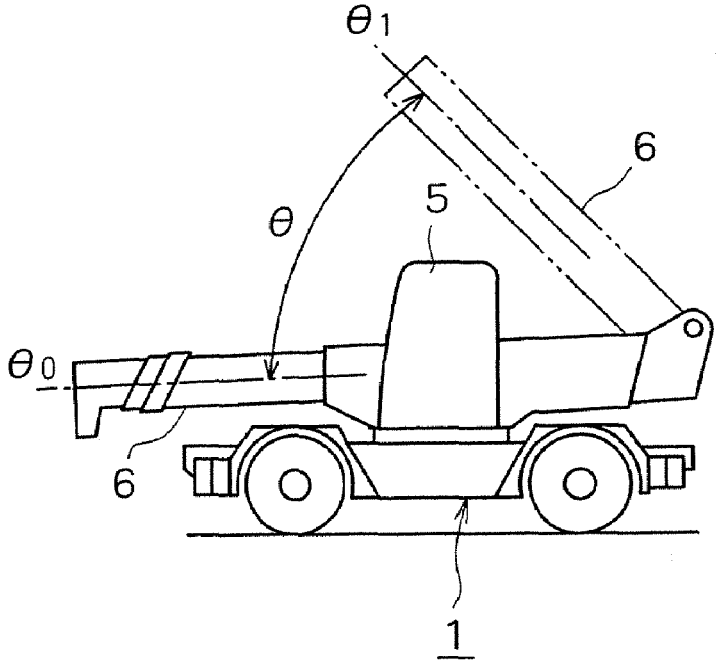
FIG. 6 is a schematic side view for explaining a boom rising/falling limiting operation in the crane.
Figure 7:
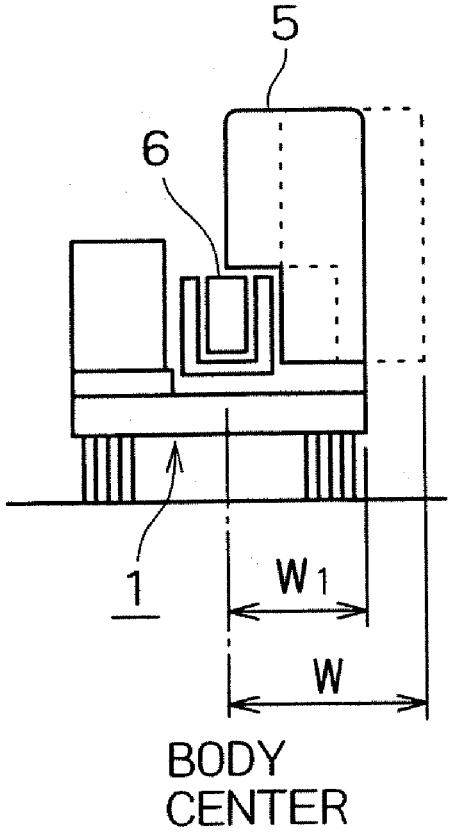
FIG. 7 is a front view of the same.
Figure 8:
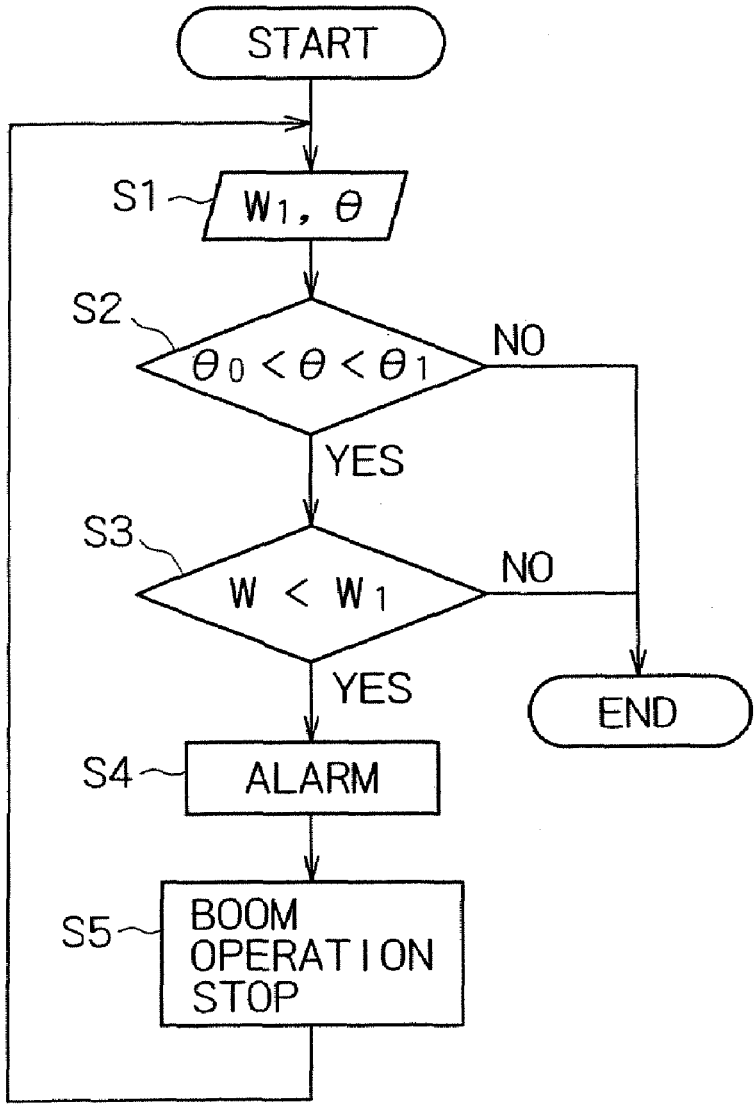
FIG. 8 is a flow chart of the same.

As shown in FIG. 6, let $\theta_0$ be the maximum fallen angle of the boom 6, $\theta_1$ be the maximum stand-up or risen angle, and $\theta$ be the stand-up angle (detection angle) of the boom 6 between the maximum fallen angle $\theta_0$ and the maximum stand-up angle $\theta_1$. Further, as shown in FIG. 7, let W1 be the distance (detection value) from the width center of the lower traveling body 1 to the outer surface of the cabin 5, and W be the distance from the width center at the side projecting position Y to the outer surface of the cabin, then the rising/falling of the boom 6 is controlled in accordance with the flow shown in FIG. 8.

First, detecting of arising/falling angle of the boom 6 by a boom angle sensor (not shown), and detecting and reading of the distance W1 by a cabin position sensor (not shown) provided on the cabin moving cylinder 22 are carried out (Step S1).

Next, in Step S2, whether $\theta$ is between $\theta_0$ and $\theta_1$ or not is judged. In case of "No" where $\theta$ is not between $\theta_0$ and $\theta_1$, the boom 6 is in the maximum fallen state, thus terminating controlling.

On the other hand, in case of "Yes" where $\theta$ is between $\theta_0$ and $\theta_1$, the step proceeds to Step S3, and W is compared with W1. In case of "No" where W1 is larger than W, there is no possible interference of the boom 6 with the cabin 5, thus terminating controlling.

On the other hand, in case of "Yes" where W1 is smaller than W, the boom 6 interferes with the cabin 5, thus starting an alarm (Step S4), and, at the same time, the boom rising/falling cylinder 11 is locked to automatically stop the rising/falling operation of the boom 6.

Incidentally, in either of the case where $\theta$ is between $\theta_0$ and $\theta_1$ (in Step S2, Yes) or the case where W1 is smaller than W (in Step S3, Yes), if an operating lever is locked, the effect equal to that of the above-described control can be obtained.

When both $\theta$ and W are used as described above, even if either an angle detection sensor for detecting a boom rising/falling angle, for example, or a cabin position detection sensor for detecting a position of the cabin 5 is down or out of order, it is possible to prevent the boom 6 from interfering with the cabin 5. Therefore, the safety and reliance of the crane can be further improved.

Further, when traveling the public road in a state that the cabin 5 is at the side projecting position Y, the cabin 5 possibly interferes with the public construction, for example, such as an electric pole. On the other hand, in a work site, it is necessary to freely rise or fall the boom 6, and the machine has to travel in a state that the cabin 5 is at a side projecting position Y as the case may be.

So, when the cabin 5 is at the side projecting position Y, whether the cabin 5 is positioned within the machine width is judged by a vehicle speed sensor and the cabin position detection sensor (not shown) so that the maximum speed is limited to be below the fixed speed (for example, 10 Km/h).

Note, pressure oil discharged from the hydraulic pump driven by the engine 12 shown in FIG. 2 is supplied, in addition to the hydraulic devices for operation disposed within the cabin 5, a beam operating cylinder (not shown) for extending and storing an outrigger beam 17*a* through a swivel joint 23 provided in the center of a rotating bearing 14, an outrigger cylinder 17*b*; a hydraulic traveling motor (not shown) for driving an axle 16 of the lower traveling body 1, and a steering device. Further, brake oil is also supplied to a brake caliper through the swivel joint 23.

Further, pressure oil discharged from the pump is supplied, without intervention of the swivel joint 23, to the frame moving cylinder 8 for moving the movable frame 9 of the rotating frame 4, the boom rising/falling cylinder 11, a boom telescoping cylinder (not shown) for telescoping the boom 6, and a winding up hydraulic motor of a winch (not shown) for winding up and down a wire rope.

According to this crane, the very heavy boom 6 passes the lower place downward (the escape portion 18) of the cabin 5 and a position close to the center of the machine width in the maximum fallen state, and therefore the center of gravity of the machine body can be lowered to a further lower position at a position close to the center of the machine width. Therefore, the width of the whole crane can be contracted while securing a tilting angle of the crane.

Moreover, the cabin 5 moves, when the boom is risen/fallen, from the width internal position X to the left obliquely rear side projecting position Y, and therefore the interference between the cabin 5 and the boom 6 when the crane is operated can be avoided.

Further, at the side projecting position Y, the operating state of the crane can be viewed from the side of the lower traveling body 1, and the forward field of view can be enlarged, thus enhance the work ability of the crane.

Further, when the cabin 5 is at the width internal position X, the rising/falling operation of the boom 6 is checked, and when the cabin 5 is at the side projecting position Y, the speed is limited, and therefore it is possible to prevent the boom 6 from erroneously impinging upon the cabin 5 to damage it, and the safety at the time of travel can be secured.

In addition, according to this crane, the boom 6 is mounted on the rear end of the movable frame 9 which moves in a backward and forward direction, through the boom foot pin 10, and in the maximum fallen state of the boom 6 (the crane's traveling state), the extreme end of the boom 6 is at the front end of the crane and the rear end thereof is at the rear end of the crane. Therefore, the boom foot pin 10 (fulcrum as rising/falling point) of the boom 6 is moved whereby the work efficiency of feeding a hanging article for moving a hanging article in a horizontal direction is enhanced. Further, the boom 6 can be made longer, or when the length of the boom 6 is made the same, the projecting amount (overhanging amount) of the boom 6 forward of the lower traveling body can be shortened to enhance the forward view of field at the time of travel, and to improve the moving into a narrow property.

Figure 9:
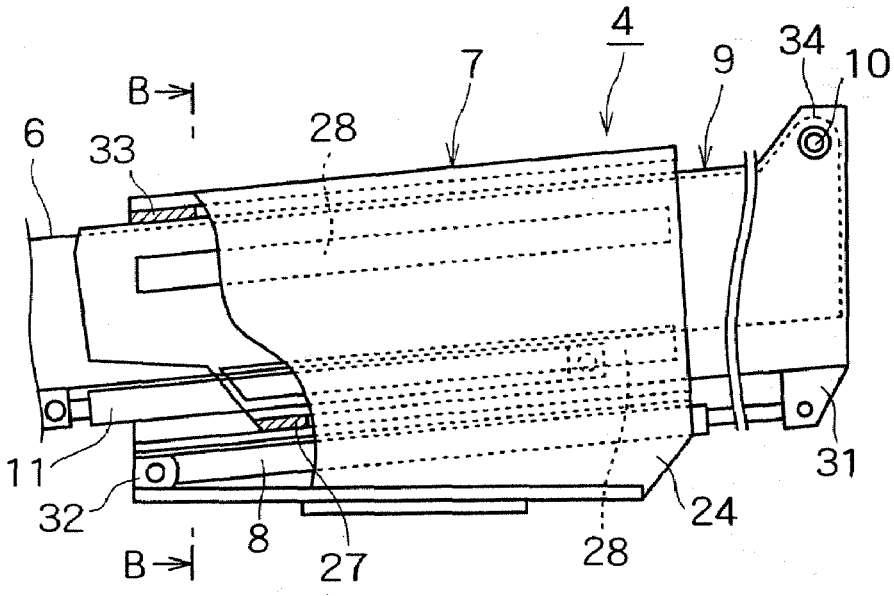
FIG. 9 is a partial side view of a rotating frame and boom in the crane.
Figure 10:
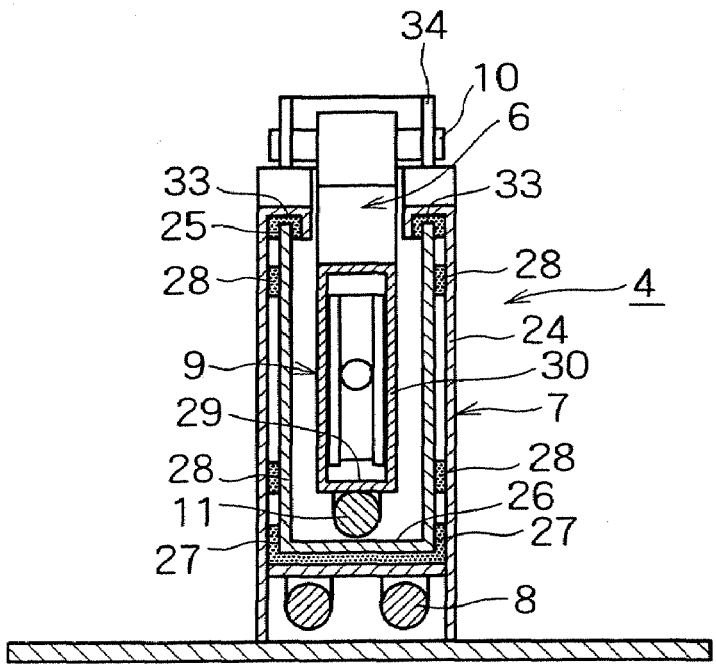
FIG. 10 is a sectional view taken on line B-B of FIG. 9.

Next, the construction of the base frame 7 of the rotating frame 4, the movable frame 9, and the boom 6 will be described with reference to FIGS. 9-11.

The base frame 7 of the rotating frame 4 has a pair of left and right bracket plates 24, 24.

The bracket plates 24, 24 have their rear portions formed to have a high front-down slope, and a guide groove 25 is formed in a backward and forward direction internally of the upper portion thereof.

Further, a bottom plate 26 is provided at the same slope as that mentioned above and approximately same slope on the lower portion between both the bracket plates 24, 24.

Pads 27, 28 are provided on the upper surface and side, respectively, of the bottom plate 26, so as to slidably guide the movable frame 9.

The movable frame 9 comprises a somewhat lengthy construction in a groove shape composed of the bottom plate 29 and a side plate 30, in which a bottom plate 29 is slidably placed on the pad 27, and the frame moving cylinder 8 is mounted between a bracket 31 provided on the rear ventral surface and a bracket 32 provided on the base frame 7 between the bracket plates 24.

Further, a pad 33 is mounted on the upper portion of the side plate 30 to engage the guide groove 25 of the bracket plate 24 so as to be slidably guided. A projecting portion 34 is formed upward at the rear of the side plate 30, and the boom 6 is provided free to rise and fall on the projecting portion 34 through the boom foot pin 10. The pads 27, 28 and 33 may be provided over the full length of the base frame 7, or may be provided only where necessary such as front and rear ends. Further, the pad 28 may be mounted through a pad carrier (a pad mounting member) as necessary, and moving in/out of the side thereof may be adjusted in shim.

In the base frame 7 of the rotating frame 4 constructed as described above, the movable frame 9 having, at the rear thereof, the boom foot pin 10 to be a fulcrum on rising/falling of the boom 6 is provided movably in a backward and forward direction by the frame moving cylinder 8, and therefore at the time of travel, the frame moving cylinder 8 is actuated so that movable frame 9 may assume a position at the rear of the base frame 7. Thereby, the projecting amount of the boom 6 forward of the rotating frame can be suppressed, and therefore the lengthy boom 6 can be mounted, and can be made longer and reduced in weight, and lowered in the center of gravity than the construction in which three stages of the boom 6 are changed to four stages in superposing as shown.

Further, operation can be performed in the state that the movable frame 9 is moved as necessary at the time of work to set the fulcrum on the rising/falling to a suitable position. Furthermore, the backward moving distance of the movable frame 9 with respect to the base frame 7 is set longer, thus enabling coping with various kinds of operations in a soft manner.

Further, the movable frame 9 is made longer in the range not to give trouble to rotation at the time of work, and projecting it long from the extreme end of the base frame 7 at the time of storage into the base frame 7, whereby the boom 6 can be lengthened.

Further, the movable frame 9 is moved at the same inclining angle as the front-down inclining angle in the maximum fallen state of the boom 6 with respect to the base frame 7. In doing so, the space required for movement of the movable frame 9 can be lessened as compared with the case of moving in a horizontal direction. Whereby, there occurs no problem in interference between the movable frame 9 and various parts of the crane, freedom of layout of devices to be equipped increases, and the whole crane can be made more compact.

Further, when the movable frame 9 moves, there is no interference between the lower traveling body 3 and the boom 6, and the boom 6 can be placed closest to the upper surface of the lower traveling body 1 in the attitude at the time of travel.

Thereby, the center of gravity of the machine at the time of travel can be lowered considerably, and the left and right tilting angle of the crane can be made large, thus enabling to narrow the width of the machine.

Further, the boom 6 is disposed so as to pass approximately the center in the width direction of the lower traveling body 1 to thereby enable to make longest.

On the other hand, where the rotating center of the rotating frame 4 is the center of the lower traveling body 1, in the state that the boom 6 is projected forward and backward of the lower traveling body 1, and if the projecting length forward and backward of the boom 6 is made approximately the same, its minimum right-angle width can be made to the smallest state.

Figure 11:
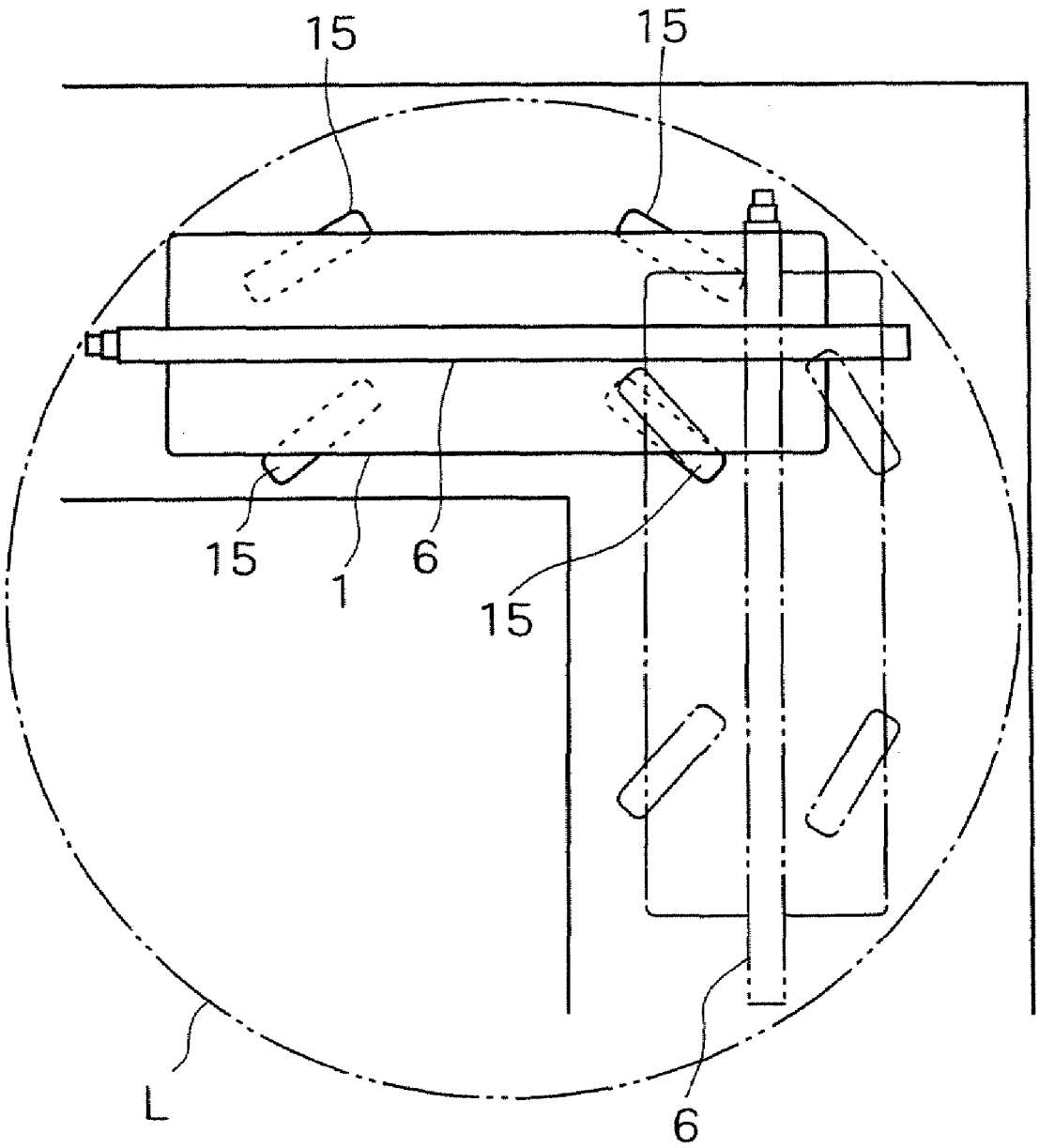
FIG. 11 is an explanatory view of entry into a right-angle road of the crane.

Further, as shown in FIG. 11, preferably, arrangement is made in which the minimum right-angle traveling locus L formed by the front end and rear end of the boom 6 are made approximately the same as that formed by of the lower traveling body 1. In doing so, the right-angle moving-in performance at the time of travel is not impaired while taking the boom 6 longest.

Note, if the locus of the front end and rear end of the boom 6 at the time of minimum rotating travel as described above is made internally from the outer end of the lower traveling body 1, needless to say, the damage caused by the interference between the boom 6 at the time of travel and an obstacle can be prevented.

Further, the hydraulic devices, the engine 12 for driving the hydraulic pump for supplying pressure oil to the hydraulic devices, and the working oil tank 13 are disposed on the base frame 7, and the boom foot pin 10 as the fulcrum on rising/falling of the movable frame 9 can be projected backward from the rear end of the lower traveling body 1. Therefore, a portion near the center of gravity of the lengthy boom 6 can be held to enhance the traveling stability. Further, with respect to the projecting amount from the machine body, there is a limitation in laws and regulations, and therefore, it is projected while dispersing it before and behind, whereby the boom 6 can be made longest.

The mounting position of the boom foot pin 10 to be the fulcrum on rising/falling of the movable frame 9 is positioned to be lower than approximately central position in the height direction of the cabin 5, whereby the heavy boom 6 is positioned downward to lower the center of gravity of the whole crane, and the side field of view and the backward field of view can be improved.

Modification of First Embodiment (1) In the first embodiment, the cabin 5 is moved in the direction away from the boom 6 by the cabin moving means 19. However, the structure may be employed in which for example, the cabin 5 is mounted on the boom 6 free to rock through the support shaft, a cylinder is provided between the cabin 5 and the boom 6, and the cabin 5 is held horizontally irrespective of the rising/falling angle of the boom 6.

(2) In the above-described embodiment, the cabin moving means 19 is provided as interference avoiding means. However, it is possible to use, in place of that mentioned above, a pair of left and right attachment support frames obliquely inclined internally of the machine body from the lower portion of the cabin 5.

The boom foot pin inclined in the width direction is provided on the attachment support frames, and the boom 6 is risen and fallen along the inclined inner surface of the attachment support frames. In doing so, the boom 6 is stored in approximately center of the width in the maximum fallen state, and is stood up in the obliquely upward direction away from the cabin 5 as stand-up operation takes place.

According to this structure, the interference between the boom 6 and the cabin 5 can be avoided without using the cabin moving cylinder 22 as in the cabin moving means 19 or using the frame moving means for moving the attachment support frames.

Further, as another interference avoiding means, the structure may be employed in which the movable frame 9 is disposed on the laterally moving bed capable of accessing/moving away from the cabin 5, whereas a pair of rail-like guides are provided in parallel with the base frame 7, and a rail-like slider which engages the rail-like guide and slides is provided on the bottom surface of the laterally moving bed respectively, and the laterally moving bed (movable frame 9) is moved by the hydraulic cylinder provided between the base frame 7 and the laterally moving bed. Even by this structure, the interference between the cabin 5 and the boom 6 can be avoided.

Further, as the drive means for moving the cabin 5, the structure may be employed in which in place of the cabin moving cylinder 22, for example, a rack is provided on the rail-like guides 20, 20, and a pinion fitted in the extreme end of an output shaft of a reversible motor provided in the cabin 5 is meshed with the rack.

Note, in the above-described embodiment, the boom 6 is disposed approximately in the center position in the width direction, but preferably, the center of the boom 6 with respect to the center of the machine is an offset amount within about 4% of the width dimension.

(3) In the first embodiment, the position of the boom foot pin 10 is at approximately central position in the height direction of the cabin 5, but if the position of the boom foot pin 10 is arranged to be further lower, the center of gravity of the crane can be further lowered.

(4) In the above-described example, an example is employed where hydraulic devices, the engine 12 for driving the hydraulic pump for supplying pressure oil to the hydraulic devices, and the working oil tank 13 are disposed on the base frame 7, and the boom foot pin 10 to be the fulcrum on rising/falling of the boom 6 can be projected backward from the rear end of the lower traveling body 1. However, the structure may be employed, in place of the above-mentioned structure, in which the engine 12 and the like are mounted on the side of the lower traveling body 1 similar to prior art, and the boom foot pin 10 is not projected backward from the rear end of the lower traveling body 1. In this case, the lower traveling body 1 itself is possibly large-scaled similar to prior art, but even so, the boom foot pin 10 can be positioned backward of the base frame 7, the boom 6 is not projected from the rear end of the lower traveling body 1 at the time of travel, and the projecting amount of the rotating frame forward can be suppressed.

(5) In the above-described example, a description is made of an example where the boom 6 is mounted to be the front-down shape from backward to forward in the maximum fallen state, but it may be mounted horizontally, in which the case, even if the fulcrum on rising/falling of the boom 6 is moved from forward position to backward position, as compared with the case of mounting to be the front-down shape, the height of the boom at the cabin side position is not lowered, and the enhancement of the field of view from side to obliquely forward is not desired, but the forward field of view can be enhanced considerably, and other aforementioned operations and effects can be likewise given.

Second Embodiment (See FIGS. 12 to 17)

Only the difference from the first embodiment will be described.

The frame moving cylinder 8 is disposed externally of the base frame 7 in the rotating frame 4, and the rod end of the cylinder 8 is connected to the extreme end of a cylinder connecting pin 36.

Figure 13:
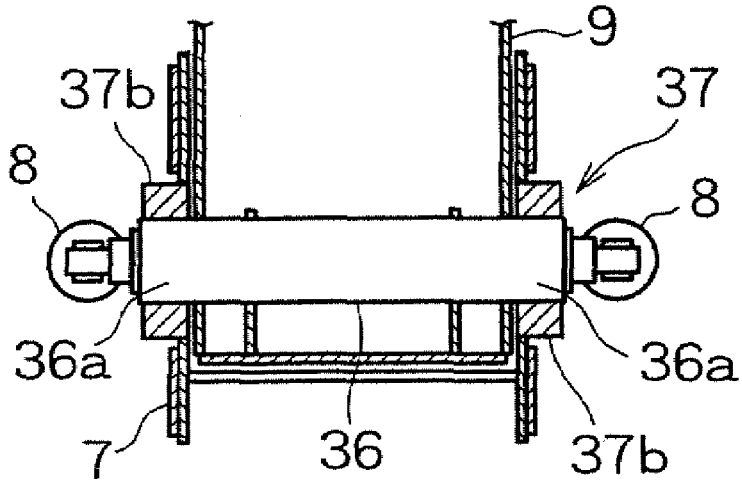
FIG. 13 is a sectional view taken on line C-C of FIG. 12.

The cylinder connecting pin 36 passes through the base frame 7 at the rear end of the movable frame 9 and at the lower position of the boom 6 (see FIG. 13).

A projecting portion from the base frame 7 of the cylinder connecting pin 36, more specifically, a portion between the side of the base frame 7 and the connecting portion of the rod of the frame moving cylinder 8 forms a an engaging portion 36*a* in engagement with a stop portion described later.

Figure 12:
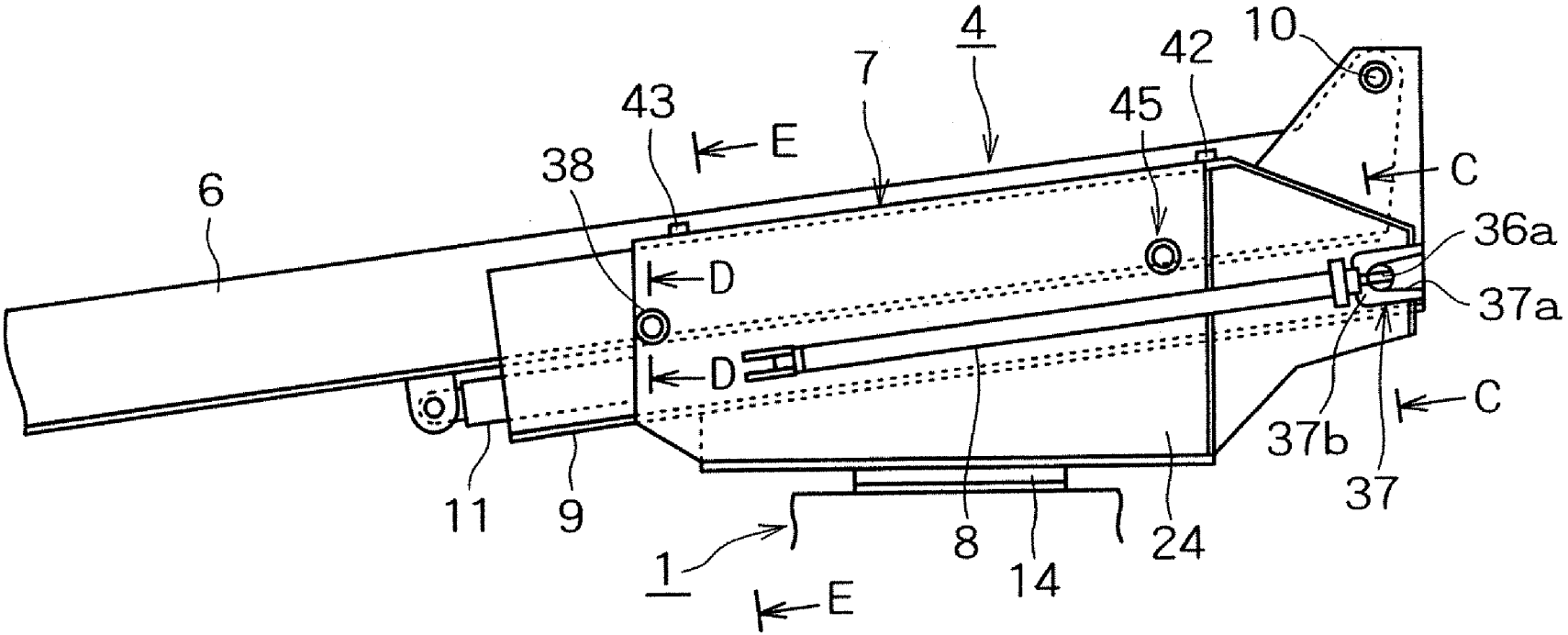
FIG. 12 is a partial side view of a rotating frame and boom in a self-traveling crane according to a second embodiment of the present invention.

Further, as shown in FIG. 12, the rear end of both bracket plates 24 of the base frame 7 is formed into an approximately lateral trapezoidal shape of which a vertical dimension reduces toward the rear end, and the extreme end thereof is formed with a stop portion 37 stops at the engaging portion 36*a* when the movable frame 9 is most contracted.

The stop portion 37 comprises a notch 37*a* whose depth portion is formed to be semicircular, and an approximately U-shaped block 37*b* having a notch (not shown) of the same shape as the notch 37*a* internally thereof, and being welded to the side of the base frame 7 so that these notches coincide with each other.

Note, the rear end portion of the base frame 7 may be flat. Further, the notch 37*a* of the stop portion 37 is formed such that the width of an opening is wide and becomes narrow toward the depth, the depth being circular, which structure is provided to secure the most contracted movable frame 9 to the base frame 7 without rattle, and therefore it is not limited to the aforementioned shape but may be formed to be rectangular shape being provided with upper and lower parallel sliding surfaces.

Further, securing means at the time of contraction 38 for securing the most contracted movable frame 9 to the base frame 7 is provided in the vicinity of the front end of both bracket plates 24 (only one side is shown in FIG. 1) of the base frame 7 and above the frame moving cylinder 9.

Figure 14:
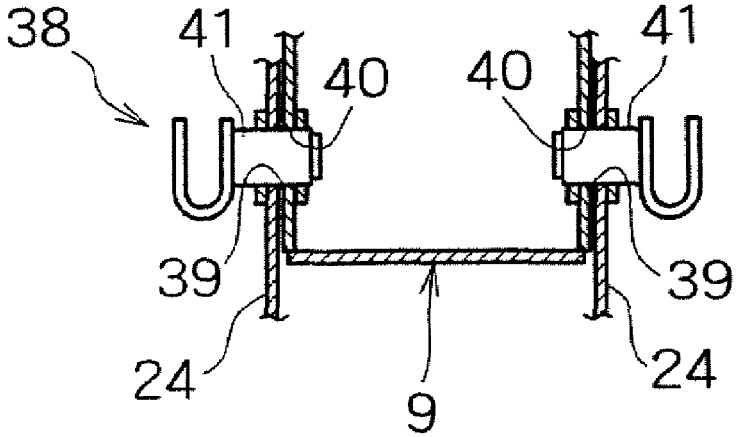
FIG. 14 is a sectional view taken on line D-D of the same.

The securing means at the time of contraction 38 comprises, as shown in FIG. 14, an external pin hole 39 provided in the bracket plate 24 of the base frame 7, an internal pin hole 40 provided in the side plate of the movable frame 9, and a fixing pin 41 inserted over the pin holes 39, 40.

Figure 16:
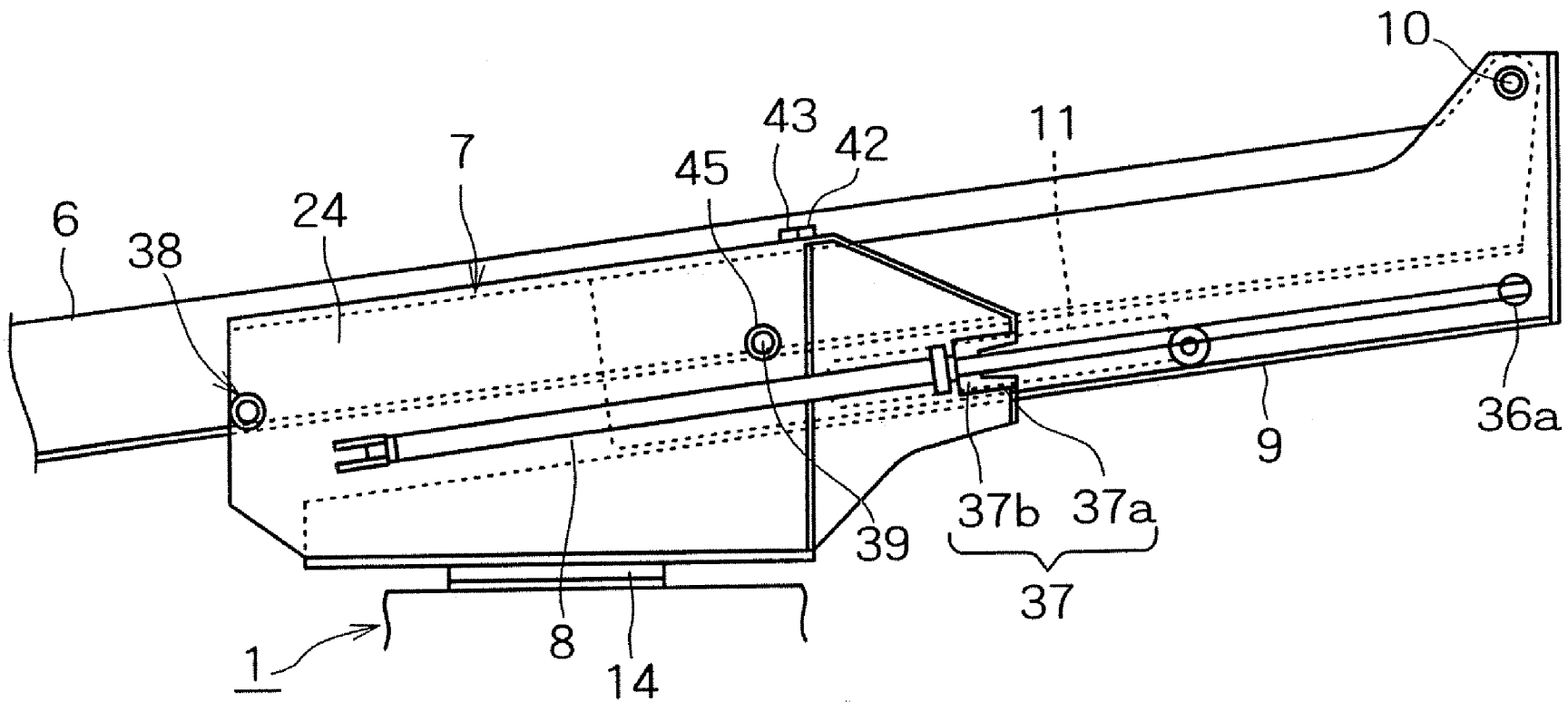
FIG. 16 is a side view of a state that a movable frame is contracted from the FIG. 12 state.

Note, stoppers 42, 42 (see FIGS. 12, 16) are provided on the rear upper end of the base frame 7 and the side of the boom 6, respectively, and these stoppers 42, 43 come into contact when the movable frame 9 in the boom fallen state shown in FIG. 16 is most extended (when moved backward) to thereby positional control of the extended state of the movable frame 9.

Figure 15:
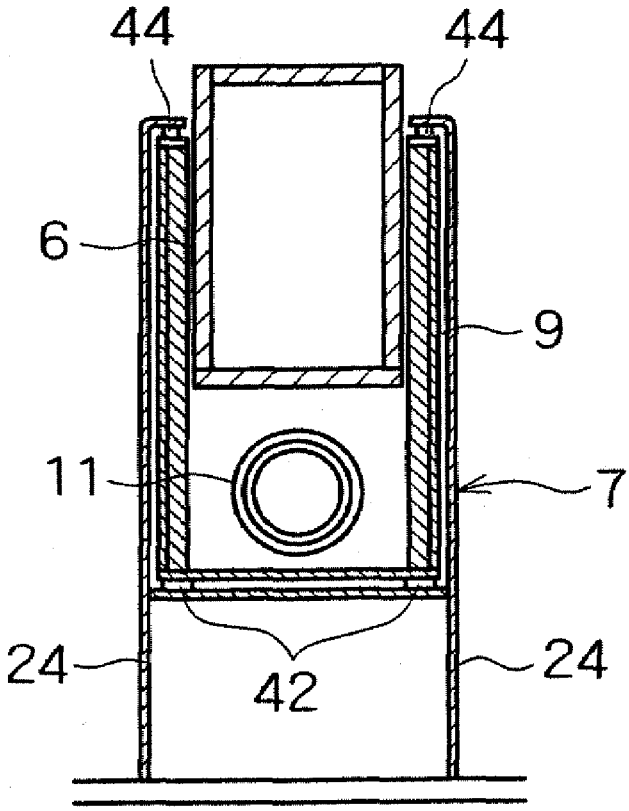
FIG. 15 is a sectional view taken on line E-E of the same.

A sectional shape of the base frame 7 is that as shown in FIG. 15, the upper ends of the left and right bracket plates 24, 24 are bended in the direction opposed to each other, a sliding pad 44 provided with a flat sliding surface is mounted on the lower surface of the bended portion and the upper surface of the bottom plate provided on the lower portion between the left and right bracket plates, and the movable frame 9 is incorporated slidably therebetween.

Further, as shown in FIG. 16, securing means at the time of extension 45 for securing the most extended movable frame 9 to the base frame 7 is provided on the side at the rear of the bracket plates 24, 24 of the base frame 7 and above the frame moving cylinder 8 in the vicinity of the base end of the lateral trapezoidal forming portion.

The securing means at the time of extension 45 comprises, similar to the securing means at the time contraction 38, an external pin hole provided in the bracket plate surface of the base frame 7, an internal pin hole provided in the side plate of the movable frame 9, and a fixing pin common to these pin holes (these are not shown), which are used in common to fixing pins 41, 41 shown in FIG. 14.

Note, the distance between the centers of the securing means at the time contraction 38 and the securing means at the time extension 45 is set to the same dimension as that of the stroke of the movable frame 9.

Figure 17:
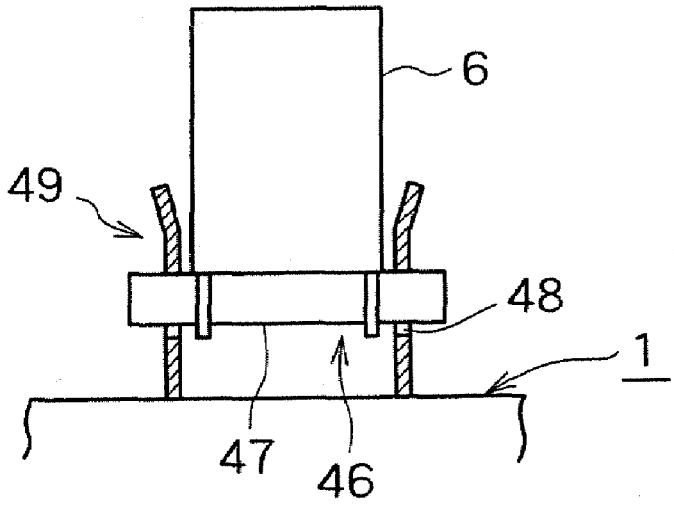
FIG. 17 is a schematic structure explanatory view with attachment fixing means viewed from front.

Further, as shown in FIG. 17, there is provided attachment fixing means 46 for preventing a rattle in vertical direction of the extreme end of the boom in the state that the movable frame 9 is most extended and the boom 6 is fallen and most contracted.

The attachment fixing means 46 comprises a fixing pin 47 supported on the bracket provided in the width direction of the ventral surface of the extreme end portion of the boom, and a notch 48 whose front portion is opened and the fixing pin 47 is fitted in.

This notch 48 is provided in a boom rest 49 projected at the front upper part of the lower traveling body 1.

Note, the structure may be employed which projects an approximately U-shaped fixing bracket having a notch at a position deviated from the boom rest 49. However, preferably, the boom rest 49 as a normally using part is used in terms of reducing cost.

According to the structure of the second embodiment, the following effects can be obtained in addition to the basically same effect as the first embodiment.

As shown in FIG. 12, when the movable frame 9 is most contracted and the engaging portion 36*a* is stopped at the stop portion 37, an upward moment acting on the movable frame 9 at the time of work is transmitted to the base frame 7 through the engaging portion 36*a* and the stop portion 37.

Accordingly, it is possible to prevent the excessive force from exerting on the upper portion at the rear end of the base frame 7, and therefore the rigidity of the bended portion of the upper portion of the movable frame 9 can be made lower. Because of this, the cost of the movable frame 9 is advantageous more than the first embodiment.

Incidentally, in case of the second embodiment, the structure is employed in which in the engaging portion 36*a* whose sectional shape is circular, the deep side thereof is stopped at the stop portion 37 of the semicircular notch. In place of this structure, an arrangement may be employed in which the engaging portion 36*a* is formed to be wedge-like shape such that the vertical dimension becomes small toward the frame moving cylinder 8, and the stop portion 27 is formed to be tapered groove-like shape whose vertical width becomes narrow toward the deep side.

In doing so, the inclined surface of the engaging portion 36*a* comes into close contact with the inclined surface of the stop portion 37, and therefore it is possible to prevent a rattle of the movable frame 9 more positively, contributing to enhancement of efficiency of the crane work.

Further, since the movable frame 9 is secured to the base frame 7 by the securing means at the time of contraction 38 provided on the side of the base frame 7, the crane vibrates when the crane operates, but the engaging portion 36*a* is not disengaged from the stop portion 37 due to the vibration, and the crane working can be carried out in the stabilized state.

Further, in the travel attitude in which the movable frame 9 is extended, and the boom 6 is fallen and most contracted, the movable frame 9 is secured to the base frame 7 by the securing means at the time of extension 45 provided on the side of the base frame 7.

Further, since the extreme end of the boom 6 is fixed by the attachment fixing means 46, even if the crane is vibrated during traveling, the movable frame 9 is not moved to the base frame 7, or the extreme end of the boom is not possibly shaky vertically. Accordingly, there occurs no possible pitching phenomenon with respect to the crane during traveling due to the causes as described, and the stabilized travel becomes enabled, thus providing the effect being comfortable to ride.

Note, in the securing means at the time of extension 45, the safety during traveling can be further enhanced by adding, at the forward side to be an open end thereof, structures such as anti-disengaging mechanism such as a difference in level, an anti-slip pin, a locking mechanism by a link-type bracket, an automatic lock by a wire cable or an electric signal, a remote release and the like.

Further, in the first and second embodiments, the structure is employed in which the sliding pad is provided in the base frame 7 and the movable frame 9 is slidably moved by the frame moving cylinder 8, but the moving means of the movable frame 9 with respect to the base frame 7 is not limited to the cylinder.

As the moving means other than the cylinder, the structure may be employed in which the movable frame 9 is moved by the structure comprising a rack and a pinion.

In this case, a rack is disposed on the ventral surface side of the boom 6, a drive motor provided with a pinion is disposed on the upper surface of the frame of the lower traveling body 1, the boom 6 is fallen to cause the pinion to mesh with the rack, the fixing pin is removed, and the drive motor is driven, whereby the movable frame 9 may be moved together with the boom 6.

Further, as a method for moving the movable frame 9 making use of a separate actuator mounted on the crane, there is mentioned the following.

That is, there is used a rope which is wound and wound back by means of a winch mounted on the back of the base end of the boom 6.

① In case that the movable frame 9 is contracted

Sheaves are provided at upper and lower positions of the rear end of the movable frame 9, a rope is stretched over the sheaves, the extreme end of the rope is connected to the base frame 7, and the rope is wound by the winch.

② In case that the movable frame 9 is extended

The extreme end of the rope stretched over boom point sheaves at the extreme end of the boom and wound and wound back by the winch is connected to the lower traveling body 1, and the rope is wound by the winch. Note, in another form of the winch driving, the movable frame can be moved in various structures by the course of the rope and the arrangement of the sheaves, such that the sheaves are disposed forward of the basic boom, and the rope end is secured to the rotating frame.

The boom telescoping cylinder is used.

① In case that the movable frame 9 is contracted

The boom 6 is extended by the boom telescoping cylinder, a stay is interposed between the extreme end of the boom 6 and the lower traveling body 1, and the boom is contracted by the boom telescoping cylinder.

② In case that the movable frame 9 is extended

The stay is interposed between the extreme end of the boom and the lower traveling body 1 to connect them, and the boom 6 is extended by the boom telescoping cylinder.

In this case, as the stay for linking the extreme end of the boom and the lower traveling body 1, suitable exclusive-use metal rod, link or the like can be used according to the projecting amount from the front end of the lower traveling body 1 of the boom 6 in the most contracted state of the movable frame, and an attachment such as a jib which is often used for hanging work can be also used.

Figure 18:
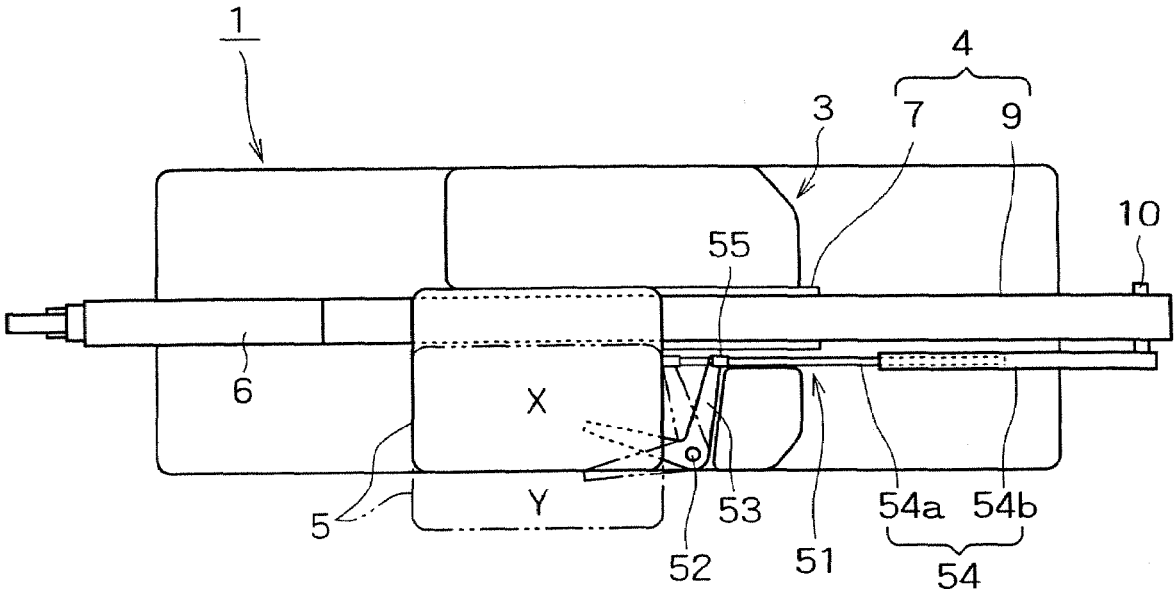
FIG. 18 is a schematic side view of the whole of a self-traveling crane according to a third embodiment of the present invention.

Third Embodiment (See FIG. 18)

Only the difference from the first and second embodiments will be described.

The cabin 5 is supported movably in the width direction by a slide mechanism comprising a guide rail and a guide roller (both of which are not shown) provided between the cabin 5 and the base frame 7, and the lower surface at the rear portion of the cabin 5 and the rear portion of the movable frame 9 are connected by a link mechanism 51.

The link mechanism 51 comprises an L-shaped turning arm 53 provided rotatably around a vertical shaft 52 on the base frame 7 and having one end pin-connected to the lower surface of the cabin through a slot, and a telescoping body 54 provided between the other end of the turning arm 53 and the rear portion of the movable frame 9.

The telescoping body 54 is constructed free to telescope in a telescoping manner by a rod 54*a* connected to the turning arm 53 through a pole joint 55, and a tube body 54*b*connected to the movable frame 9.

In the turning center portion of the turning arm 53 is provided a spring (not shown) for biasing the arm 53 to a position shown by the solid line in FIG. 18.

In this structure, when the movable frame 9 extends and moves when the crane operates, the telescoping body 54 is most contracted in the midst of movement thereof to press the turning arm 53.

Thereby, the turning arm 53 turns outward around the vertical shaft 52 as shown by the two-dot contour line in FIG. 18, and the cabin 5 is moved from the width internal position X to the side projecting position Y by the arm turning force.

According to this structure, the cabin 5 moves to the side projecting position Y capable of avoiding the interference with the boom 6 in the movable frame contracted state to be a crane working attitude, and therefore a more safe mechanical interlock function can be obtained as compared with the case where the cabin 5 is moved by a separate actuator (for example, the cabin moving cylinder 22 in the first embodiment).

Further, since the exclusive-use actuator is not required, the structure can be simplified to reduce the cost.

Figure 19:
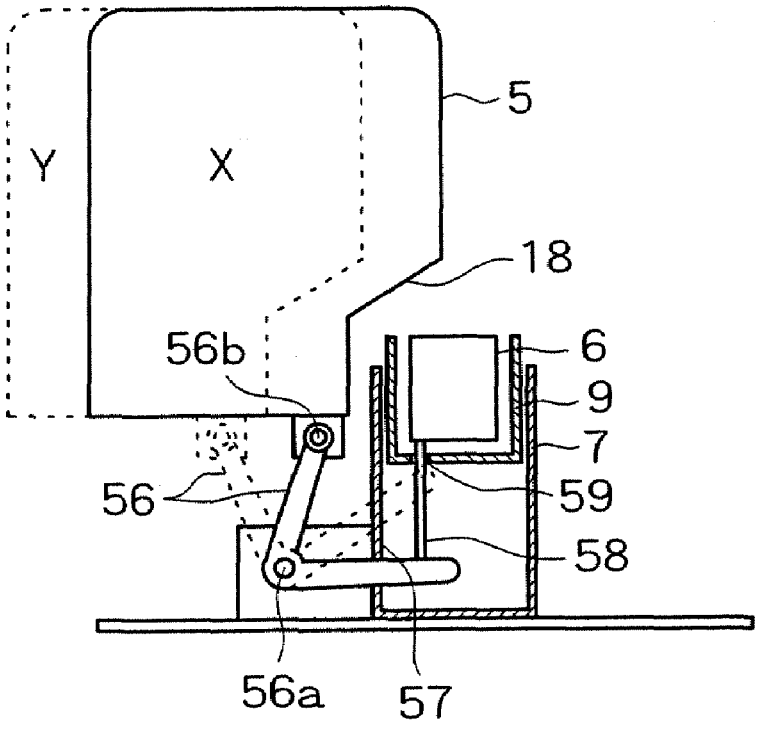
FIG. 19 is a schematic sectional view of an upper traveling body of a self-traveling crane according to a modification of the third embodiment.

As a modification of the third embodiment, the structure can be employed in which as shown in FIG. 19, the cabin 5 is moved between the width internal position X and the side projecting position Y using the boom falling force and the spring force.

That is, similarly to the third embodiment, downwardly of the cabin 5 supported movably in the width direction by the slide mechanism, the L-shaped turning arm 56 is mounted turnably around a horizontal shaft 56*a*, and one end of the turning arm 56 is connected to the lower surface of the cabin through a pole joint 56*b* (in place of which a slot may be used).

The other end of the turning arm 56 passes through a longitudinal slot 57 of the base frame 7 to face to a portion below the movable frame 9, and the extreme end of a pressing rod 58 mounted downward of the lower surface of the boom 6 is placed in contact with the other end of the turning arm 56. Reference numeral 59 denotes a pressing rod introducing hole provided in the movable frame 9.

In the turning center portion of the turning arm 56 is provided a spring for biasing the arm 56 to a position shown by the broken line (moving the cabin 5 to the side projecting position Y).

Note, the cabin 5 is provided with an escape portion 18 with respect to the boom 6.

Further, as means for securing the cabin 5 to the width internal position X, mutually engaging brackets (not shown) is provided at a position where the cabin 5 and the base frame 7 correspond to each other, and the operation for connecting and releasing the brackets can be carried out within the cabin 5.

Further, preferably, a damper such as hydraulic damper is provided between the turning arm 56 and the base frame 7 in order to carry out the turning motion of the arm caused by the spring force.

In this structure, in the state that the boom 6 is fallen, the rotating arm 56 is held at a position shown by the solid line in the figure by the pressing rod 58, and the cabin 5 is held at the width internal position X.

When the boom 6 is erected from that state, the pressing rod 58 rises, and therefore the turning arm 56 is turned to the position indicated by the dashed line by the spring force, and the cabin 5 is extended to the side projecting position.

Further, when the boom 6 is fallen, the turning arm 56 is rotated to the solid-line position by the pressing rod 58, and the cabin 5 moves to the width internal position X.

Even by this structure, the basically same effects as the third embodiment can be obtained.

Note, as specific means for making use of a drive force of another actuator for the purpose of automating movement of the cabin, a wire rope, a chain, or a rack and a pinion gear or the like can be used. As the actuator for obtaining the drive force, any other means that is provided on the upper rotating body can be used.

Figure 20:
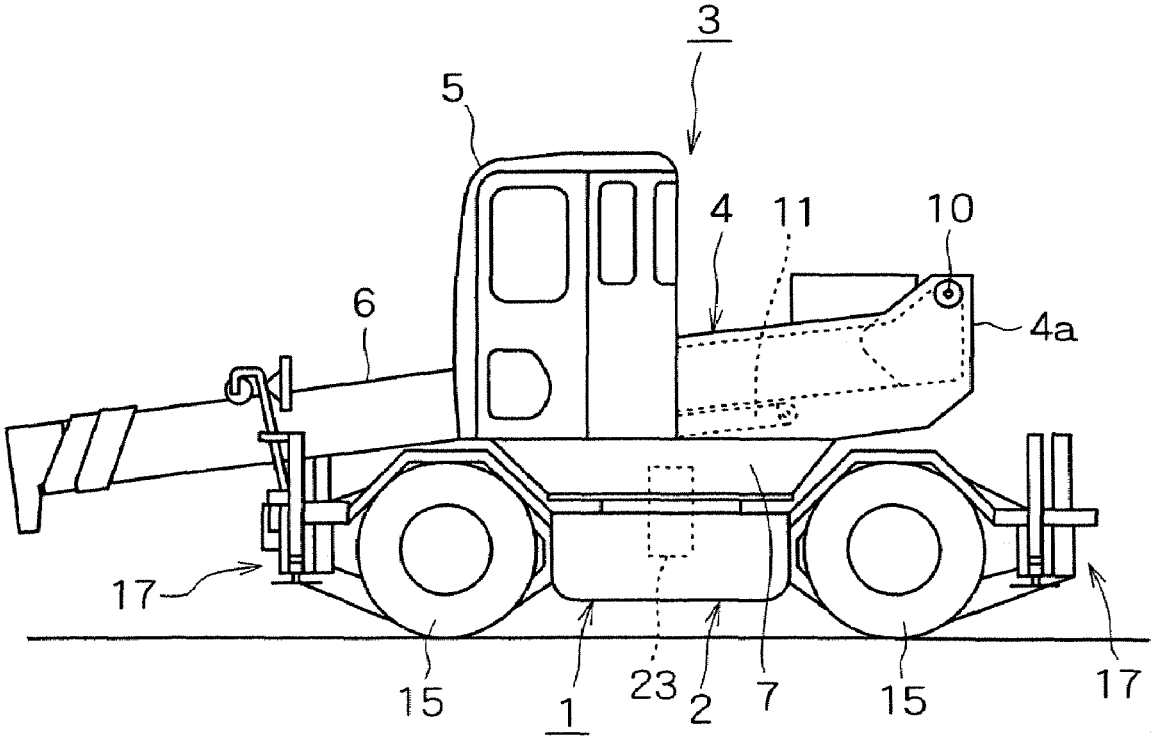
FIG. 20 is a schematic side view of the whole of a self-traveling crane according to a fourth embodiment of the present invention.

Forth Embodiment (See FIG. 20)

In the above-described embodiment, the rotating frame 4 comprises the base frame 7 and the movable frame 9, and the boom 6 is mounted on the movable frame 9 (see FIG. 1), whereas in the third embodiment, the boom 6 is supported free to rise/fall through the boom foot pin 10 on the bracket portion 4*a* provided at the upper part at the rear of the integrated type rotating frame 4, similarly to the conventional crane.

Even by this structure, the following effects approximately equal to both the first and second embodiments can be obtained.

① The center of gravity of the machine body can be lowered to a lower position at a position close to the center in the width direction of the crane, and therefore the width of the crane can be contracted while securing a tilting angle.

② The crane working state can be visual recognized from the side of the lower traveling body 1 by movement of the cabin 5 to the side projecting position Y, and therefore the forward field of view can be enlarged to enhance the efficiency of the crane work.

③ Since the boom 6 is not possibly interfered with the cabin 5, the damage of the cabin 5 or the boom 6 caused by the interference of the boom 6 can be prevented, and there occurs no trouble in movement in the work site.

Fifth to Seventh Embodiments (See FIGS. 21 to 26)

The following the fifth to seventh embodiments are characterized in structure of the lower traveling body 1. However, since the structure of the upper rotating body is the same as the first and second embodiment, illustration and description thereof are omitted, and reference is made to the drawings in the first and second embodiments as necessary.

Figure 21:
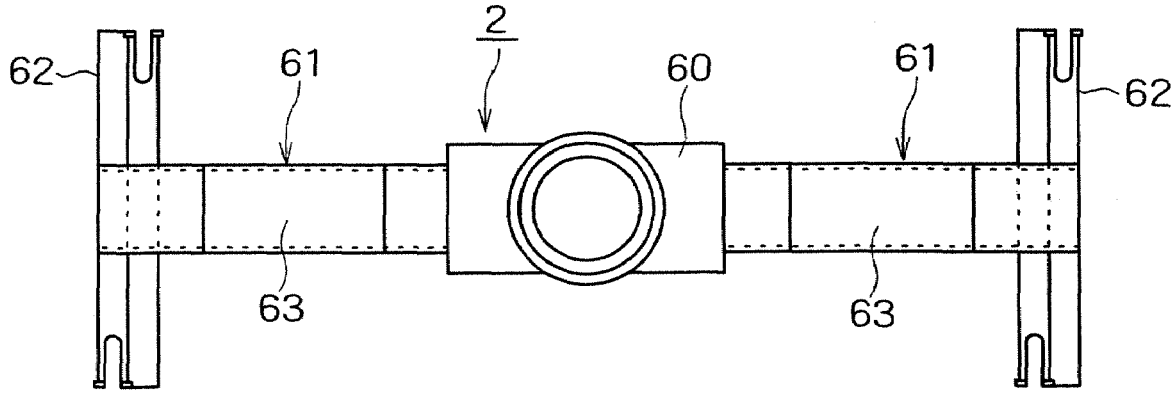
FIG. 21 is a plan view of a traveling frame of a lower traveling body in a self-traveling crane according to a fifth embodiment of the present invention.
Figure 22:
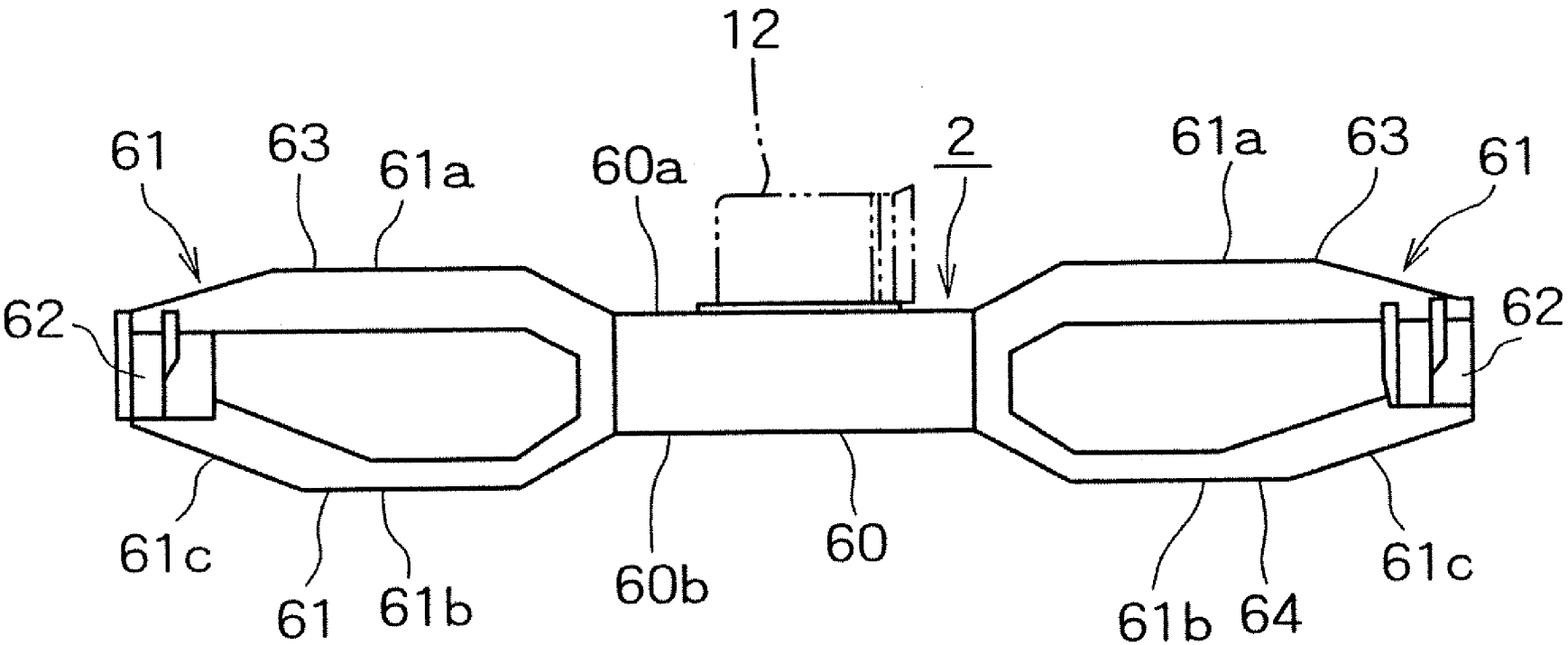
FIG. 22 is a side view of the same.

Fifth Embodiment (See FIGS. 21, 22)

Approximately box-shaped rotating pedestals 60 as rotating base on which an upper rotating body is mounted through a rotating bearing are provided approximately in the center in lengthwise and width directions of the traveling frame 2 of the lower traveling body.

Axle support portions 61, 61 for supporting the axle 16 shown in FIG. 2 are provided on both front and rear sides of the rotating pedestal 60, and the axle support portions 61 forward and rearward the front axle support portion 61 are provided backward thereof with outrigger support portions 62, 62.

As shown in FIG. 22, the upper surface 60*a* of the rotating pedestal 60 is to be positioned at a level lower than the upper surfaces 61*a*, 61*a* of both the axle support portions 61, 61.

That is, according to this crane, the upper surface 60*a* of the rotating pedestal 60 for supporting the upper rotating body 3 shown in FIGS. 1, 2 is set to be lower than the case of the conventional crane. Thereby, since the position of the center of gravity of the whole crane can be lowered, there exerts an excellent effect that the travel stability is enhanced. On the other hand, the lower surface 60*b* of the rotating pedestal 60 is set to a level higher than the lower surfaces 61*b*, 61*b* of both the axle support portions 61, 61 and inclined surfaces 61*c*, 61*c* inclined obliquely upward toward the outside in the lateral direction of the traveling frame 2 are formed at the rear of the lower surfaces 61*b* of both the axle support portion.

Thereby, the lower surface 60*b* of the rotating pedestal 60 of the traveling frame 2 lowered in the center of gravity when the crane travels is not possibly placed in contact with the ground, and therefore, there occurs no obstacle in travel, and further when moving into a hill or slope, or moving out of a hill, the lower surface of the axle support portions 61, 61 is not possibly placed in touch with the ground.

Incidentally, the lower surface 60*b* of the rotating pedestal 60 will suffice to be higher than the lower surface of both the axle support portions 61, 61. A difference in level between the upper surface 60*a* of the rotating pedestal 60 and the upper surfaces 61*a*, 61*a* of both the axle support portions 61, 61 is preferably large in the range capable of securing the strength of the rotating pedestal 60.

Both the axle support portions 61, 61 comprise an upper frame member 63 and a lower frame member 64 for sandwiching the axle 16 shown in FIG. 2 in a vertical direction.

Both the upper and lower frames 63, 64 have a cross section constructed to a rectangular closed sectional construction, and a coefficient of section of parts in a lateral direction is designed to be a value corresponding to stress exerting on the parts.

Accordingly, the rigidity of the axle support portions 61, 61 can be enhanced, no possible excess or short occurs in the rigidity of parts in the lateral direction of the upper frame member 63 and the lower frame member 64, and there is no surplus quality part, which is useful for light-weighting the traveling frame 2.

Further, both outrigger support portions 62, 62 are supported while being sandwiched in the direction perpendicular to the lateral direction of the traveling frame 2 by the upper frame member 63 and the lower frame member 64.

Accordingly, the outrigger device 17 shown in FIGS. 1, 2 can be supported with high strength, and the rigidity of both upper and lower frame members 63, 63 is also enhanced, therefore contributing to the reduction in vibration during traveling, and the safety during crane traveling.

Further, similarly to the first embodiment, the engine 12 shown in FIG. 2 is mounted on the upper rotating body 3 so that an engine mounting section is needless to be provided on the traveling frame 2, and therefore the traveling frame 2 can be made compact. Further, since the position of the upper rotating body 3 is also lowered, the position of the center of gravity of the whole crane can be lowered.

Further, according to this structure, the upper surface 60*a* of the rotating pedestal 60 is low and positioned at a level lower than the upper end of the axle as described above, and therefore a heavy article is put in a falling state on the upper rotating body 3 above the rotating pedestal 60 as shown by the two-dot contour line in FIG. 22.

While in the figure, the engine 12 is illustrated as the heavy article, the working oil tank 13 shown in FIG. 2 or a fuel tank (not shown) may be installed. In doing so, the whole crane can be further lower the center of the gravity.

It is preferable that the center of rotating is arranged in the vicinity of a central portion of the wheel base (between axles). In doing so, the heavy article can be arranged most efficiently.

Figure 23:
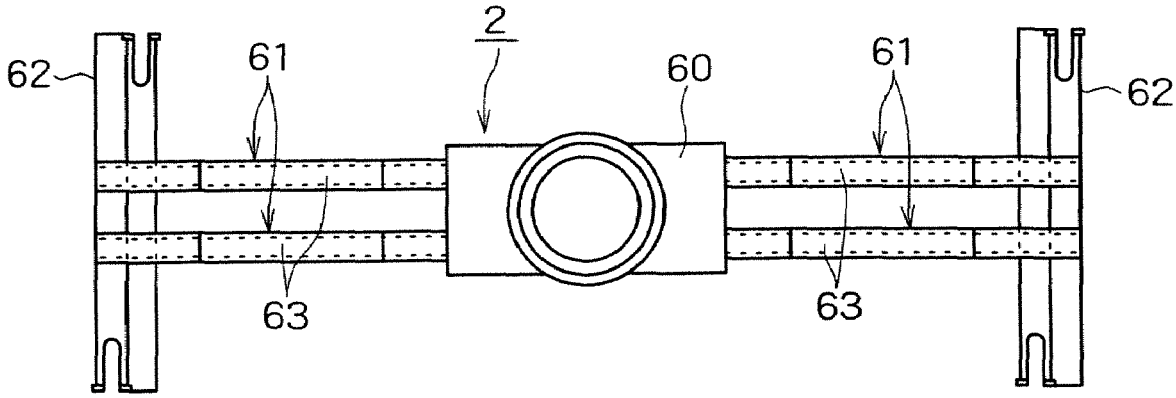
FIG. 23 is a plan view of a traveling frame of a lower traveling body in a self-traveling crane according to a sixth embodiment of the present invention.
Figure 24:
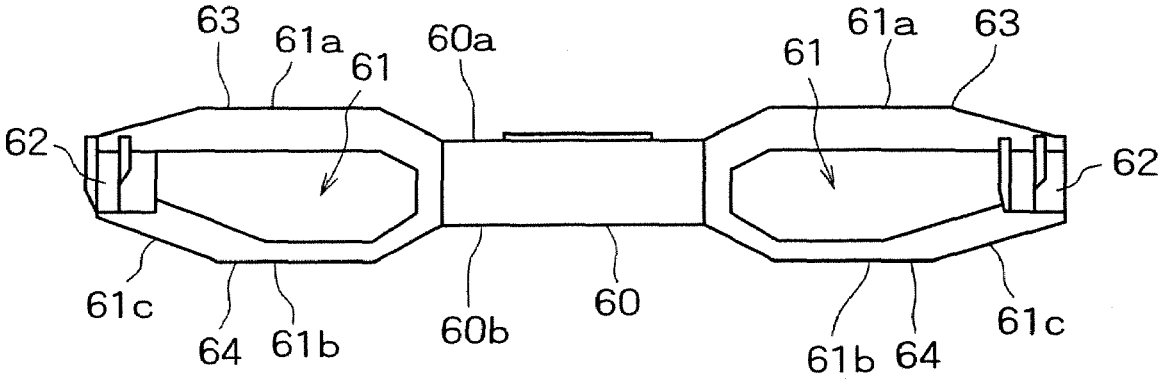
FIG. 24 is a side view of the same.

Sixth Embodiment (See FIGS. 23, 24)

In the sixth embodiment, the construction of both axle support portions 61, 61 of the traveling frame 2 are different from the fifth embodiment.

Only the aforementioned different portion will be described. As shown in FIG. 23, upper and lower frame members 63, 64 of both axle support portions 61, 61 are divided into two (left and right).

According to this structure, in addition to the effects of the fifth embodiment, machines and tools such as a valve, pipe lines, electric wires and the like can be disposed in a space formed in the upper and lower frame members 63, 64, thus contributing to the enhancement of the disposing space for these machines and tools, pipelines, electric wires and the like.

Further, the frame members 63, 64 divided into two (left and right) will be the construction for connecting left and right parts of the outrigger support portion 62, thus providing additional effects of being advantageous with respect to the strength or twisting.

Figure 25:
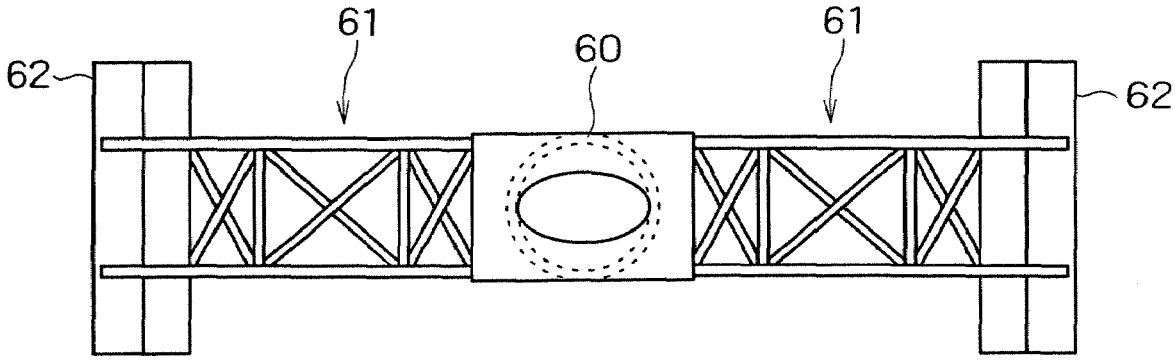
FIG. 25 is a plan view of a lower traveling body in a self-traveling crane according to a seventh embodiment of the present invention.
Figure 26:
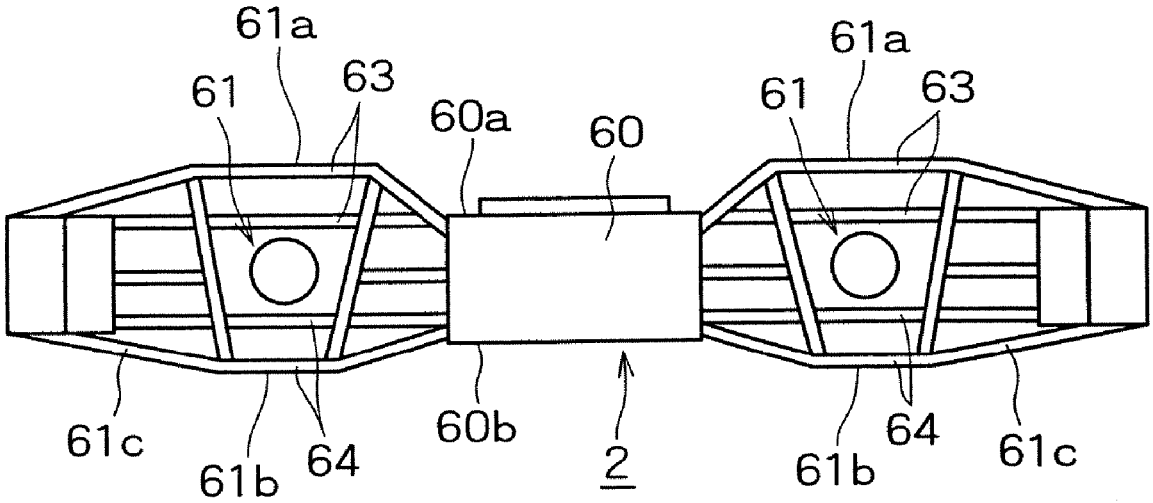
FIG. 26 is a plan view of the same.
Figure 27:
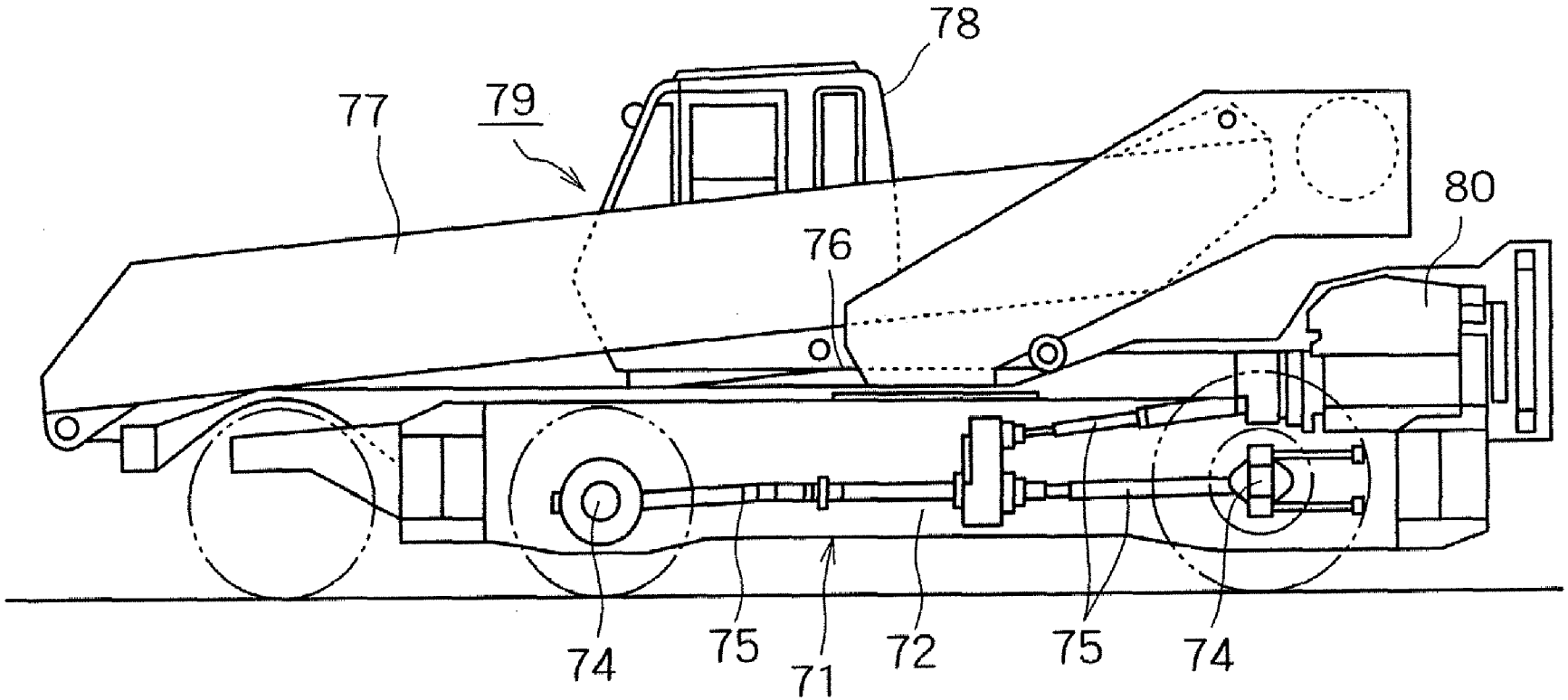
FIG. 27 is a schematic side view of the whole showing a conventional self-traveling crane.
Figure 28:
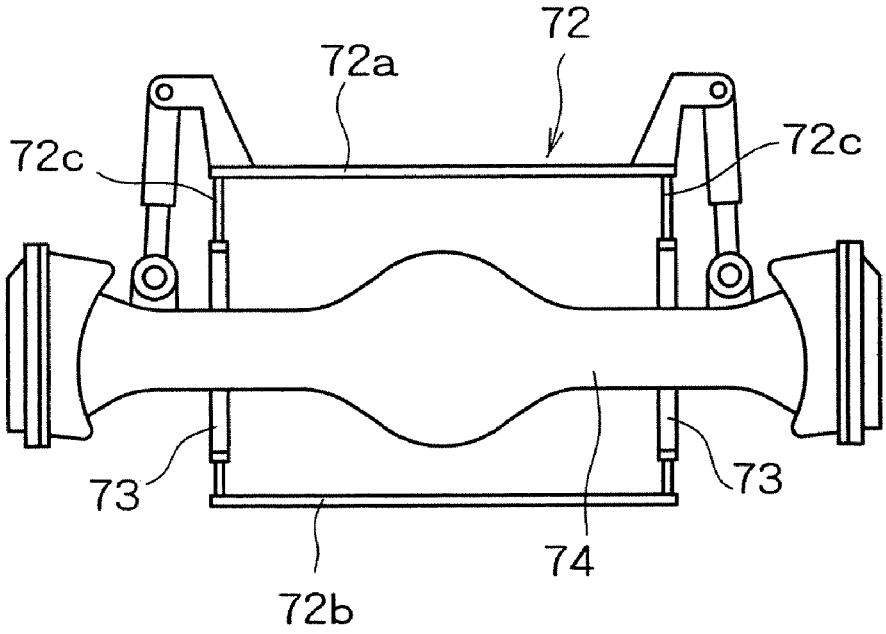
FIG. 28 is a front view showing a positional relation between a traveling frame and an axle in the crane.
Figure 29:
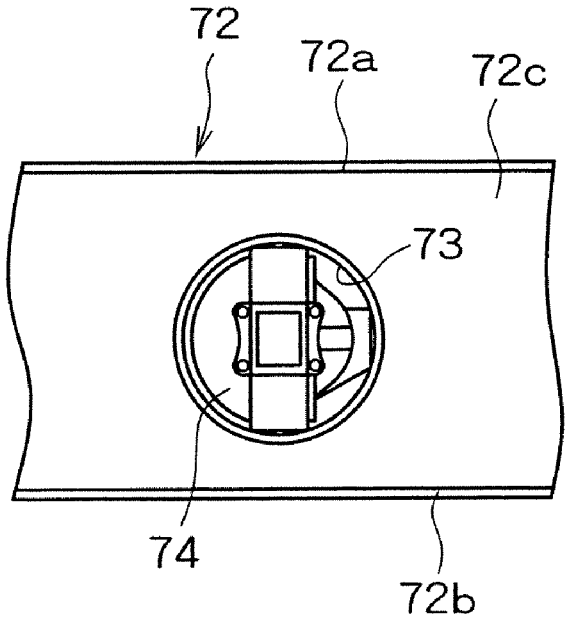
FIG. 29 is a side view of the same.

Seventh Embodiment (See FIGS. 25, 26)

In the seventh embodiment, both axle support portions 61, 62 of the traveling frame 2 are of a lattice construction comprising steel pipes.

As described, even if both the axle support portions 61, 61 are changed to the lattice construction, the effects equal to the fifth and sixth embodiments can be obtained.

AVAILABILITY IN INDUSTRY

As described above, according to the present invention, the working attachment is arranged so as to transversely extend at a lower side of the cabin when the self-traveling working machine travels. Therefore, the position of the center of gravity of the self-traveling working machine can be lowered, in addition, the working attachment can be moved close to the center of the machine width by the amount that the working attachment is superposed to the cabin, thus enabling contraction of the width of the self-traveling machine by the amount superposed to the cabin.

Further, according to the present invention, in the self-traveling working machine in which the rotating pedestal is provided in the vicinity of a central portion of the traveling frame of the self-traveling working machine, and the axle support portions are provided on both front and rear sides of the rotating pedestal, the upper surface of the rotating pedestal is constructed to position lower than the upper surface of both the axle support portions, thus enabling lowering the upper surface of the rotating pedestal for supporting the upper rotating body than prior art. Therefore, it is possible to lower the center of gravity of the machine body and enhance the traveling safety.

Furthermore, according to the present invention, in the self-traveling working machine provided with a lengthy working attachment as in the multi-step telescopic boom, it is possible to make the body longer and make the weight lighter without impairing the narrow moving-in property and narrow working property by the working attachment and without increasing the number of stages of the working attachment.

The invention claimed is:

1. A wheeled crane comprising:

an upper rotating body, a traveling frame of a lower traveling body, wherein said traveling frame is provided with a rotational base for rotatably supporting said upper rotating body in a vicinity of a central portion of the traveling frame and axle supporting portions provided forward and rearward, respectively, of the rotating base, wherein an uppermost surface of said rotational base is positioned downward from an upper surface of the axle supporting portions, wherein a lowermost surface of said rotational base is on a level above a lower surface of said axle supporting portions, wherein said axle supporting portions are constructed of an upper frame member and a lower frame member for sandwiching an axle between the upper and lower frame members in upper and lower directions; and tires mounted to said axle, wherein the uppermost surface of said rotational base is positioned downward from the tops of said tires.

2. The wheeled crane according to claim 1, further comprising a rotating bearing for rotatably supporting said upper rotating body disposed upward of said rotational base.

3. The wheeled crane according to claim 1, wherein an inclined surface to be inclined obliquely upward toward an outside in a backward and forward direction of said traveling frame is formed on a lower surface of said axle supporting portions.

4. A self-traveling working machine comprising:

an upper rotating body, a traveling frame of a lower traveling body, wherein said traveling frame is provided with a rotational base for rotatably supporting said upper rotating body in a vicinity of a central portion of the traveling frame and axle supporting portions provided forward and rearward, respectively, of the rotating base, wherein an upper surface of said rotational base is positioned downward from an upper surface of the axle supporting portions, wherein said axle supporting portions are constructed of an upper frame member and a lower frame member for sandwiching an axle between the upper and lower frame members in upper and lower directions, and said upper frame member and said lower frame member are constructed to be a closed sectional construction.

5. The self-traveling working machine according to claim 4, further comprising an outrigger supporting portion for supporting an outrigger in a direction perpendicular to a backward and forward direction of the traveling frame at front end and rear end portions of said traveling frame, and wherein said outrigger supporting portion is sandwiched and supported between both of said upper and lower frame members.

6. The self-traveling working machine according to claim 4, wherein both of said upper and lower frame members are divided into two, respectively, to the left and right of said traveling frame.

* * * * *